US010119503B2

(12) United States Patent
Zhang et al.

(10) Patent No.: US 10,119,503 B2
(45) Date of Patent: Nov. 6, 2018

(54) METHOD AND SYSTEM FOR VACUUM GENERATION IN AN INTAKE

(71) Applicant: Ford Global Technologies, LLC, Dearborn, MI (US)

(72) Inventors: Xiaogang Zhang, Novi, MI (US); Jianwen James Yi, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 226 days.

(21) Appl. No.: 15/081,151

(22) Filed: Mar. 25, 2016

(65) Prior Publication Data

US 2017/0276102 A1 Sep. 28, 2017

(51) Int. Cl.
*F02M 35/10* (2006.01)
*F02D 9/02* (2006.01)

(52) U.S. Cl.
CPC ..... *F02M 35/10118* (2013.01); *F02D 9/02* (2013.01); *F02M 35/10229* (2013.01); *F02D 2009/024* (2013.01)

(58) Field of Classification Search
CPC ..... F02M 35/10118; F02M 35/10229; F02D 9/02; F02D 2009/024
See application file for complete search history.

(56) References Cited

U.S. PATENT DOCUMENTS 4,044,077 A * 8/1977 Gupta ..... F02M 9/02 123/590
5,359,977 A * 11/1994 Abbey ..... F02M 9/14 123/337
6,502,397 B1 * 1/2003 Lundqvist ..... F02M 26/10 60/605.1
6,886,545 B1 * 5/2005 Holm ..... F02D 9/12 123/568.21
7,032,578 B2 4/2006 Liu et al.
7,624,575 B2 * 12/2009 Noelle ..... F01D 25/24 60/605.1
8,047,185 B2 11/2011 Ulrey et al.
8,261,716 B2 9/2012 Bergbauer et al.
9,051,902 B2 * 6/2015 Jones ..... F02M 25/0722
9,074,540 B2 * 7/2015 Subramanian ..... F02D 41/0077
9,097,419 B2 * 8/2015 Zatti ..... F23D 14/60
9,771,902 B2 * 9/2017 Polcyn ..... F02M 26/70
2007/0036694 A1 2/2007 Nishioka et al.
2007/0199549 A1 * 8/2007 Weisz ..... F02D 9/18 123/568.18
2009/0050120 A1 * 2/2009 Bischofberger ..... F02M 35/10118 123/568.11

(Continued)

OTHER PUBLICATIONS

Zhang, Xiaogang et al., "Method and System for an Aspirator for a Brake Booster," U.S. Appl. No. 14/941,238, filed Nov. 13, 2015, 36 pages.

(Continued)

*Primary Examiner* — Hung Q Nguyen
*Assistant Examiner* — Brian P Monahon
(74) *Attorney, Agent, or Firm* — Julia Voutyras; McCoy Russell LLP

(57) ABSTRACT

Methods and systems are provided for a vacuum generating device. In one example, a vacuum generating device comprises a venturi device upstream of an annular fixture for adjusting an amount of vacuum provided to a vacuum consumption device.

15 Claims, 8 Drawing Sheets

(56) References Cited

U.S. PATENT DOCUMENTS

2013/0340732 A1* 12/2013 Pursifull ..... F02M 35/10222
123/572

OTHER PUBLICATIONS

Zhang, Xiaogang et al., "Urea Mixer," U.S. Appl. No. 15/042,680, filed Feb. 12, 2016, 35 pages.

* cited by examiner

METHOD AND SYSTEM FOR VACUUM GENERATION IN AN INTAKE

FIELD

The present description relates generally to vacuum generation in an intake via one or more vacuum devices.

BACKGROUND/SUMMARY

Vehicle systems may include various vacuum consumption devices that utilize vacuum. These may include, for example, a brake booster and a purge canister. Vacuum used by these devices may be provided by a dedicated vacuum pump. In other embodiments, one or more aspirators (alternatively referred to as ejectors, venturi pumps, jet pumps, and eductors) may be coupled in the engine system that may harness engine airflow and use it to generate vacuum.

In one example embodiment shown by Bergbauer et al. in U.S. Pat. No. 8,261,716, a control bore is located in the wall of the intake such that when the throttle valve is at idle position, vacuum generated at the periphery of the throttle is used for a vacuum consumption device. Therein, the positioning of the throttle valve in an idle position provides a constriction at the throttle valve's periphery. The increasing flow of intake air through the constriction results in a Venturi effect generating a partial vacuum. The control bore is sited so as to utilize the partial vacuum for a vacuum consumption device.

However, as recognized by the inventors herein, in the approaches described above, the vacuum generation potential of the throttle may be limited. For example, a single control bore at one location in the intake, as shown in U.S. Pat. No. 8,261,716, is utilized by the vacuum consumption device even though vacuum may be generated at the entire periphery of the throttle. To use vacuum generated at the entire periphery of the throttle, more control bores may be needed in the intake passage. However, fabricating these control bores may result in significant modifications to the design of the intake passage which can increase related expenses. Furthermore, the throttle is unable to provide vacuum when in a closed position. This may limit a vehicle ability to replenish vacuum to the vacuum consumption device.

In one example, the issues described above may be addressed by a system comprising a venturi device displaceable along an axis of an intake passage, an inwardly projecting fixture radially spaced away from the axis and in sealing contact with an intake pipe of the intake passage, and a first venturi passage located between the venturi device and the intake pipe and a second venturi passage located between the axis and the fixture. In this way, the venturi passages annularly surround the venturi device and the fixture.

As one example, the venturi device comprises a plurality of perforations fluidly coupled to a throat of the first venturi passage such that vacuum generated in the passage may be supplied to an interior chamber of the venturi device. Likewise, the fixture comprises a plurality of apertures fluidly coupled to a throat of the second venturi passage such that vacuum generated in the passage may be supplied to an annular chamber of the fixture. The vacuum may promote air flow from the vacuum consumption device to both the venturi device and the fixture. Furthermore, displacing the venturi device along the axis may adjust an amount of vacuum generated in the passages thereby adjusting an amount of air flowing out of the vacuum consumption device to the venturi device and/or the fixture. As an example, displacing the venturi device toward the annular fixture increases an amount of vacuum generated.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-4C are shown approximately to scale, although, other relative dimensions may be used.

DETAILED DESCRIPTION

Figure 1:
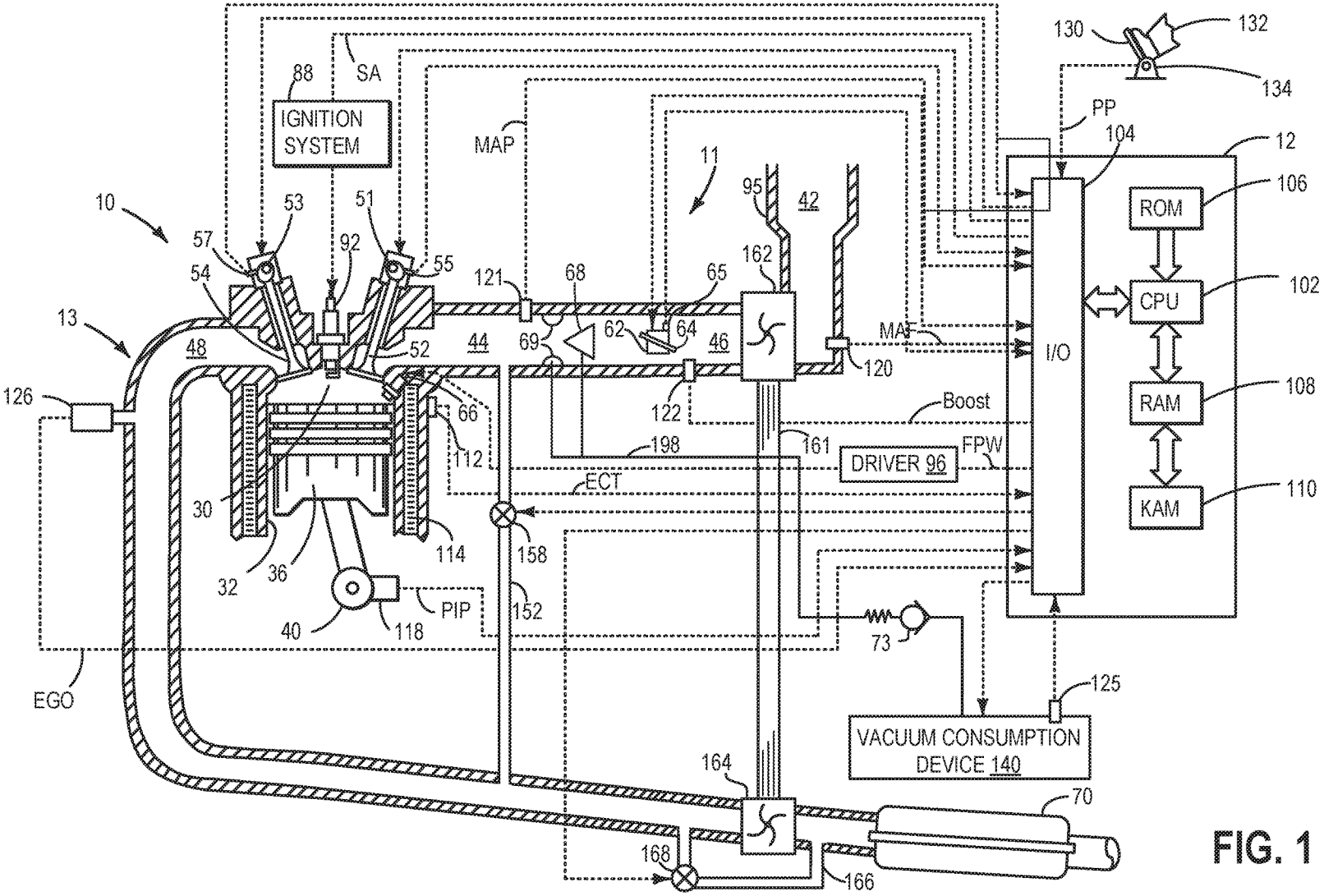
FIG. 1 depicts a schematic diagram of an engine in accordance with the present disclosure.
Figure 2:
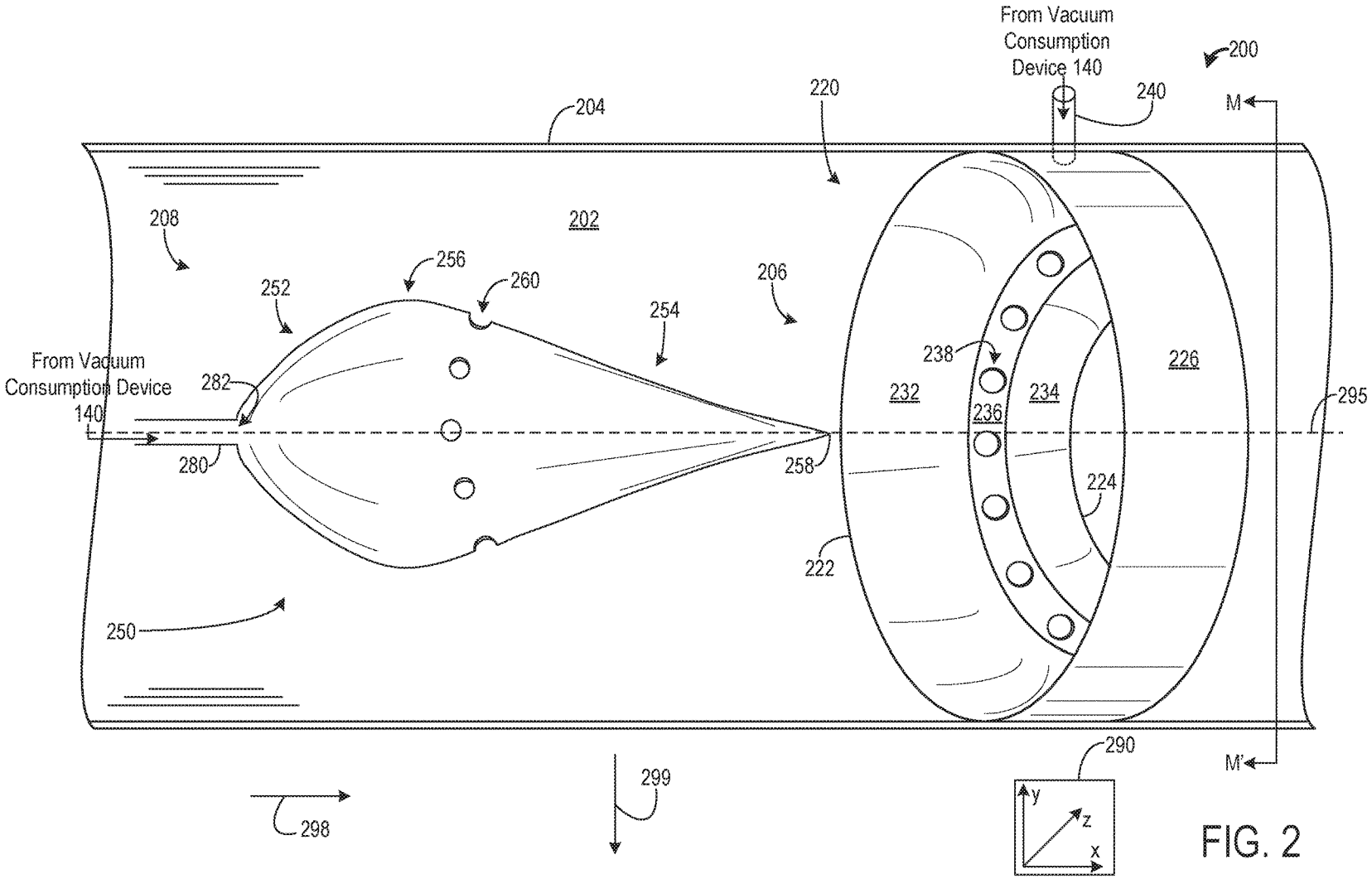
FIG. 2 depicts a variable venturi device and an annular fixture coupled to a vacuum consumption device.
Figure 3:
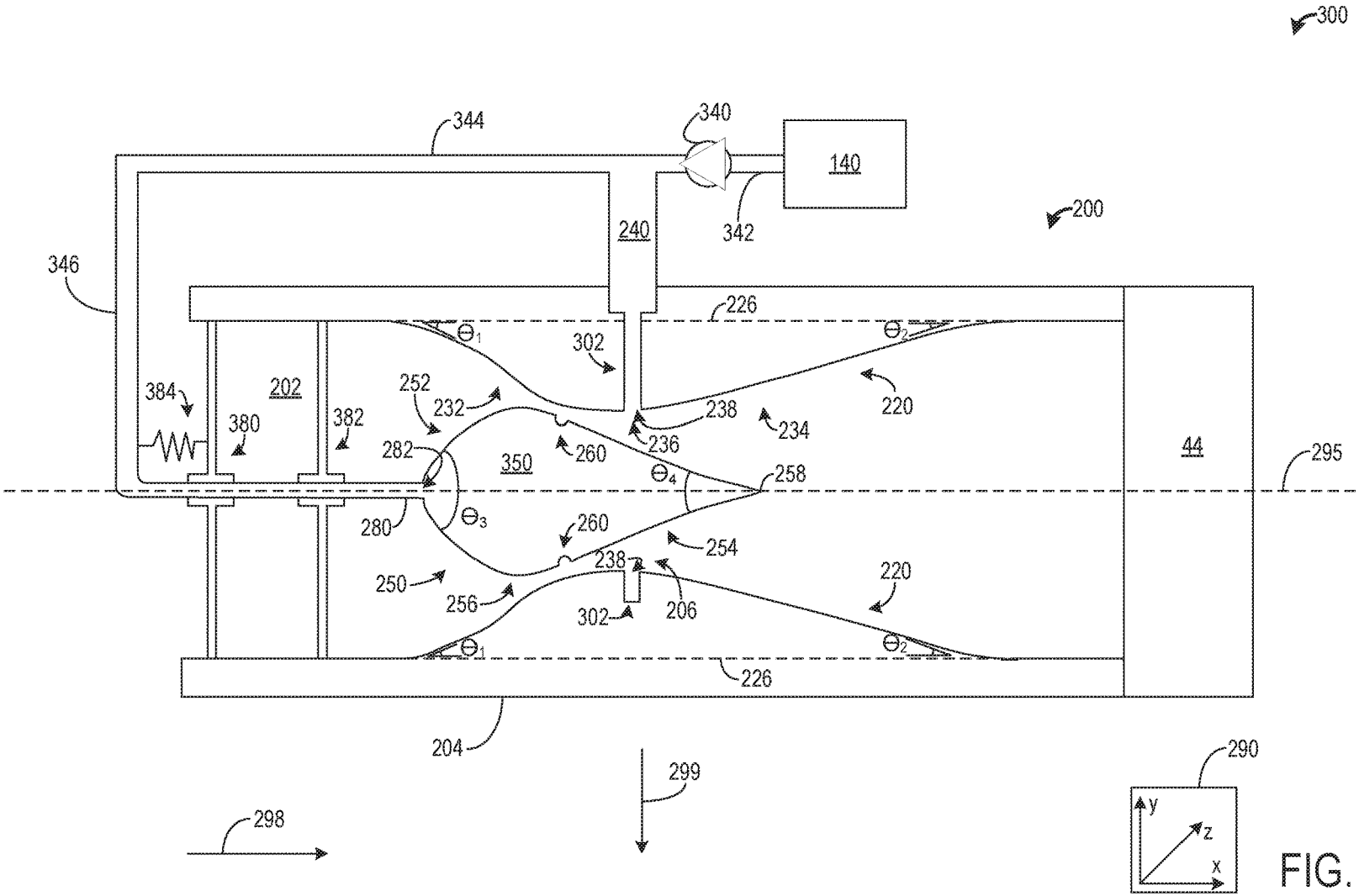
FIG. 3 shows a cross-sectional view of the variable venturi and the annular fixture.
Figure 4A:
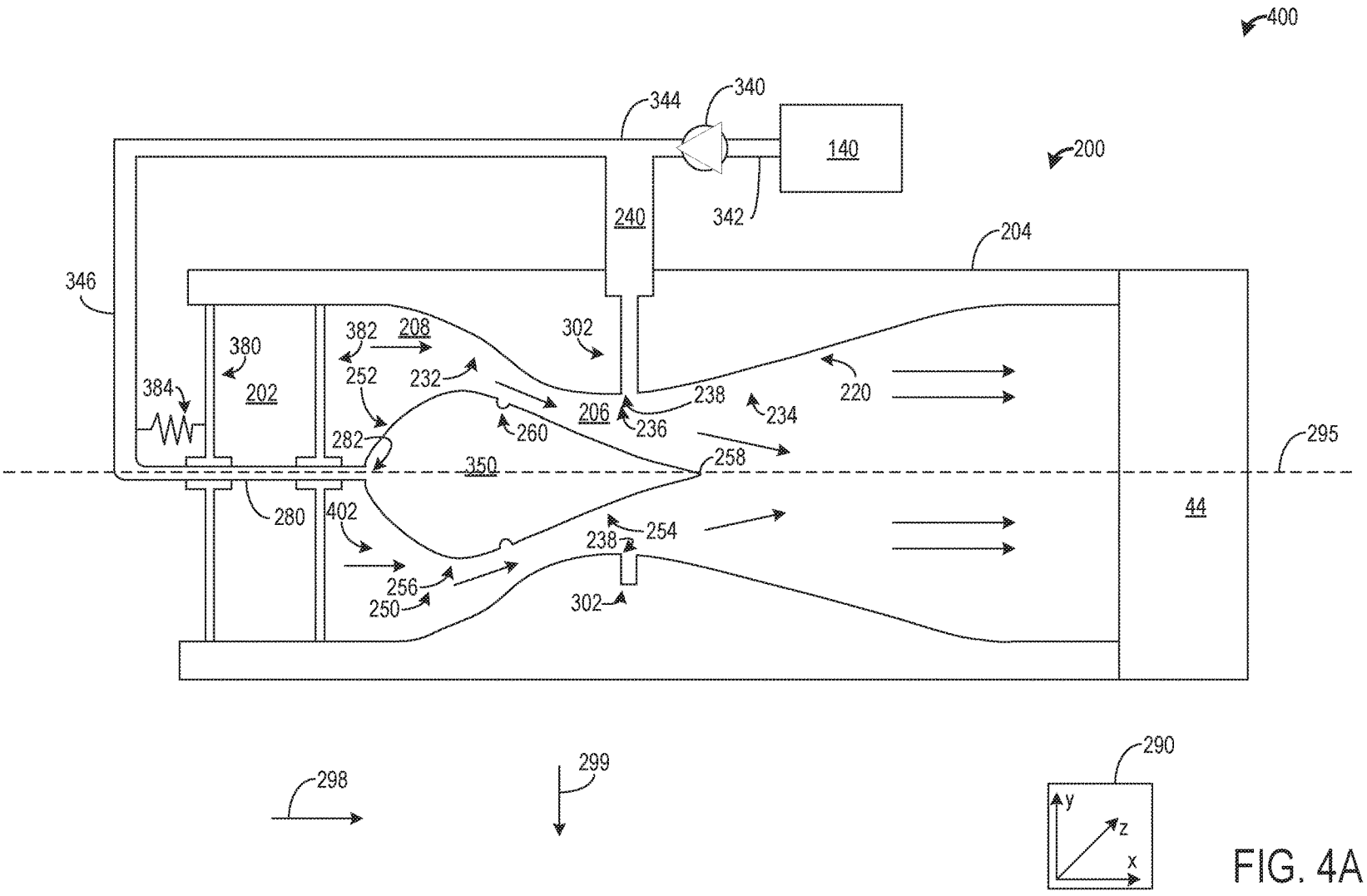
FIG. 4A shows a cross-sectional view of the variable venturi in an open first position.
Figure 4B:
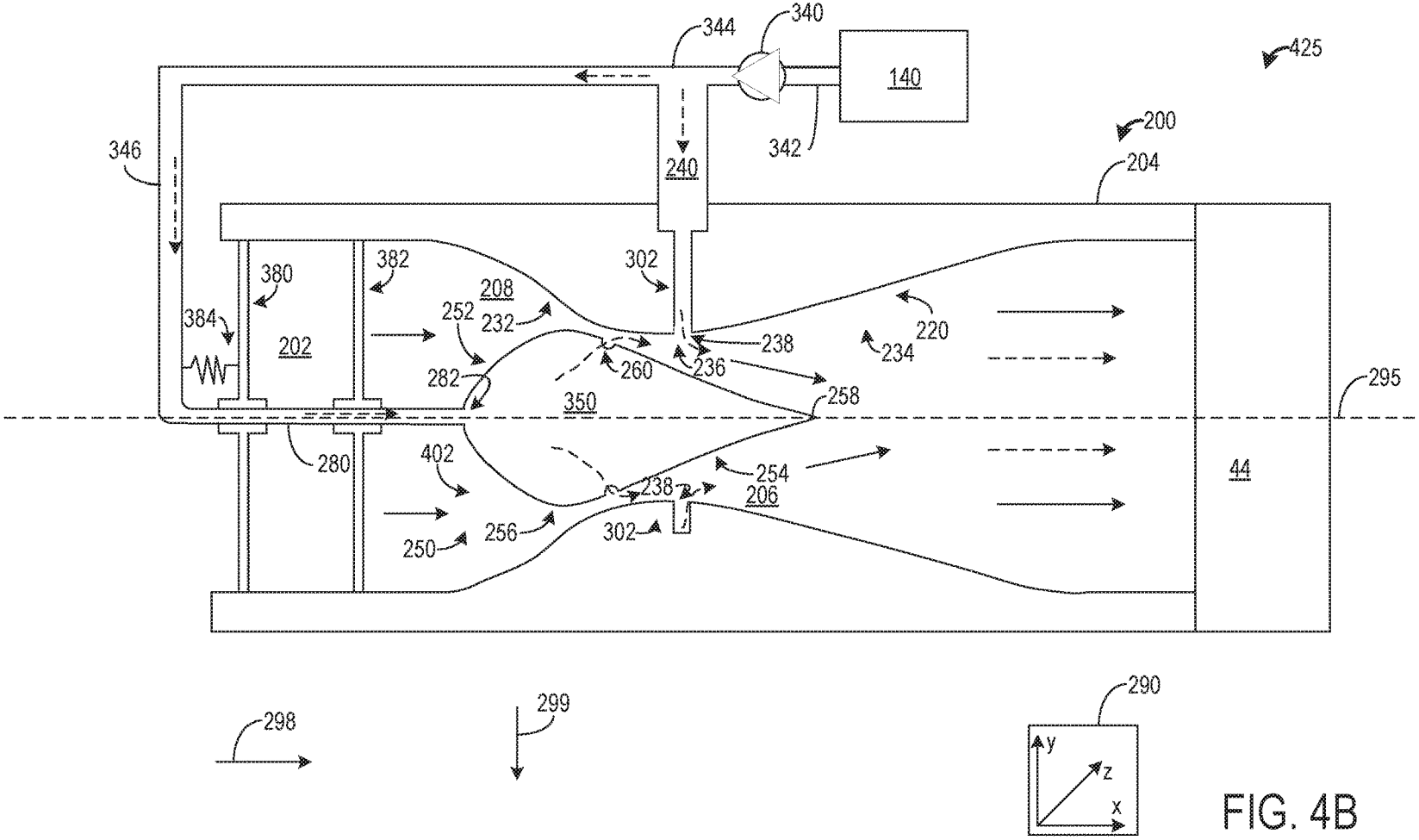
FIG. 4B shows a cross-sectional view of the variable venturi in an intermediate second position.
Figure 4C:
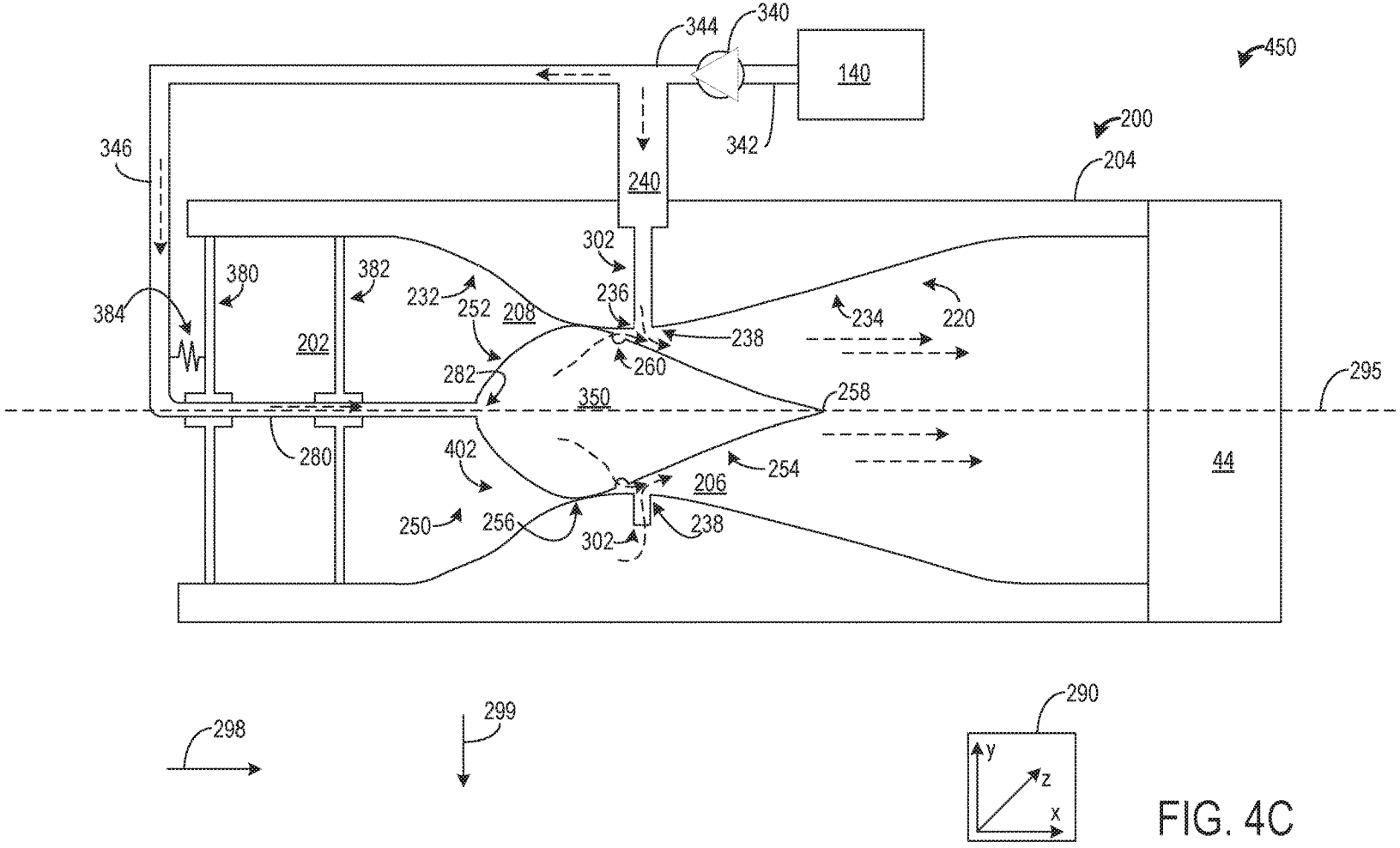
FIG. 4C shows a cross-sectional view of the variable venturi in a closed third position.
Figure 5:
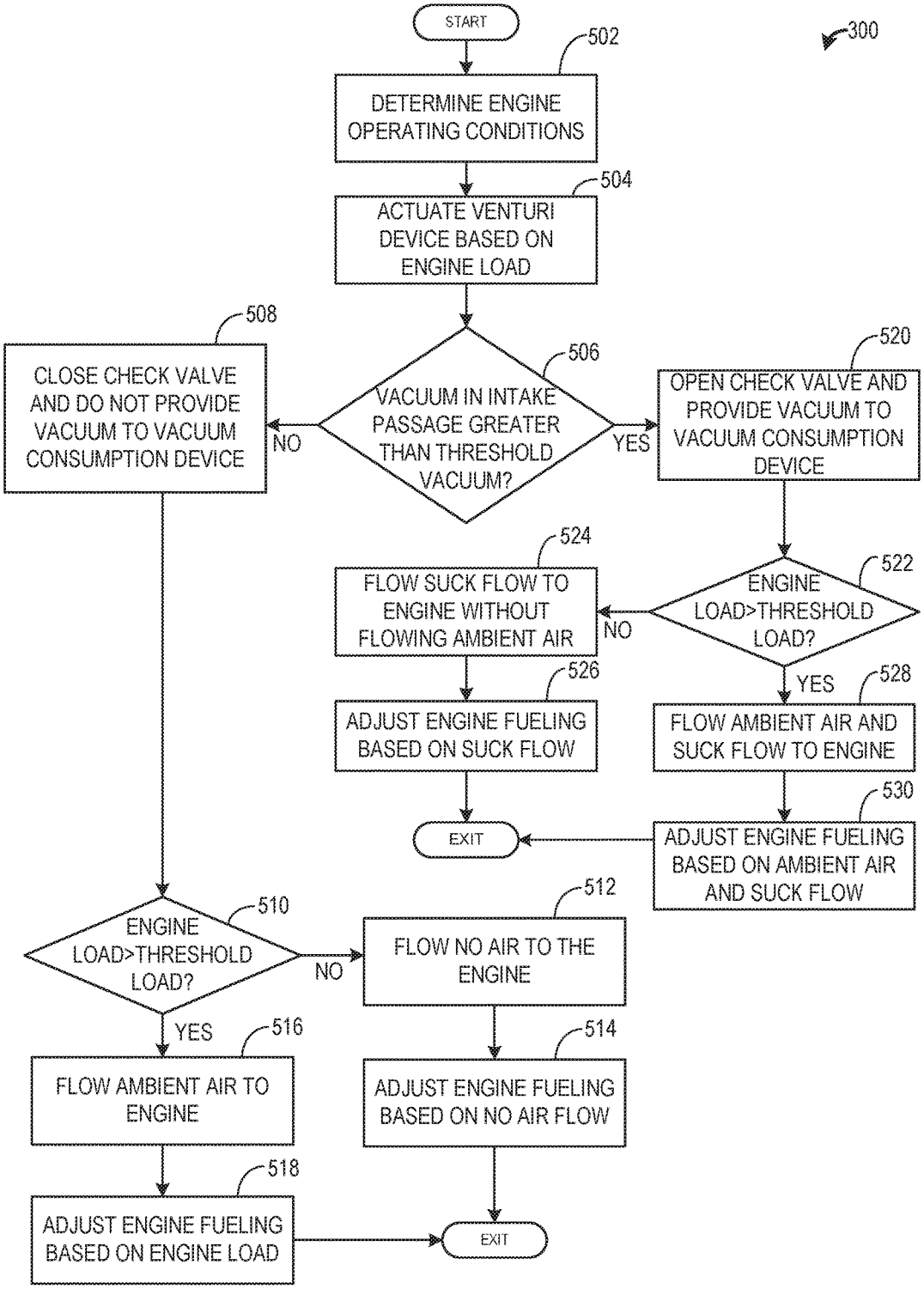
FIG. 5 shows a method for moving the venturi device.
Figure 6:
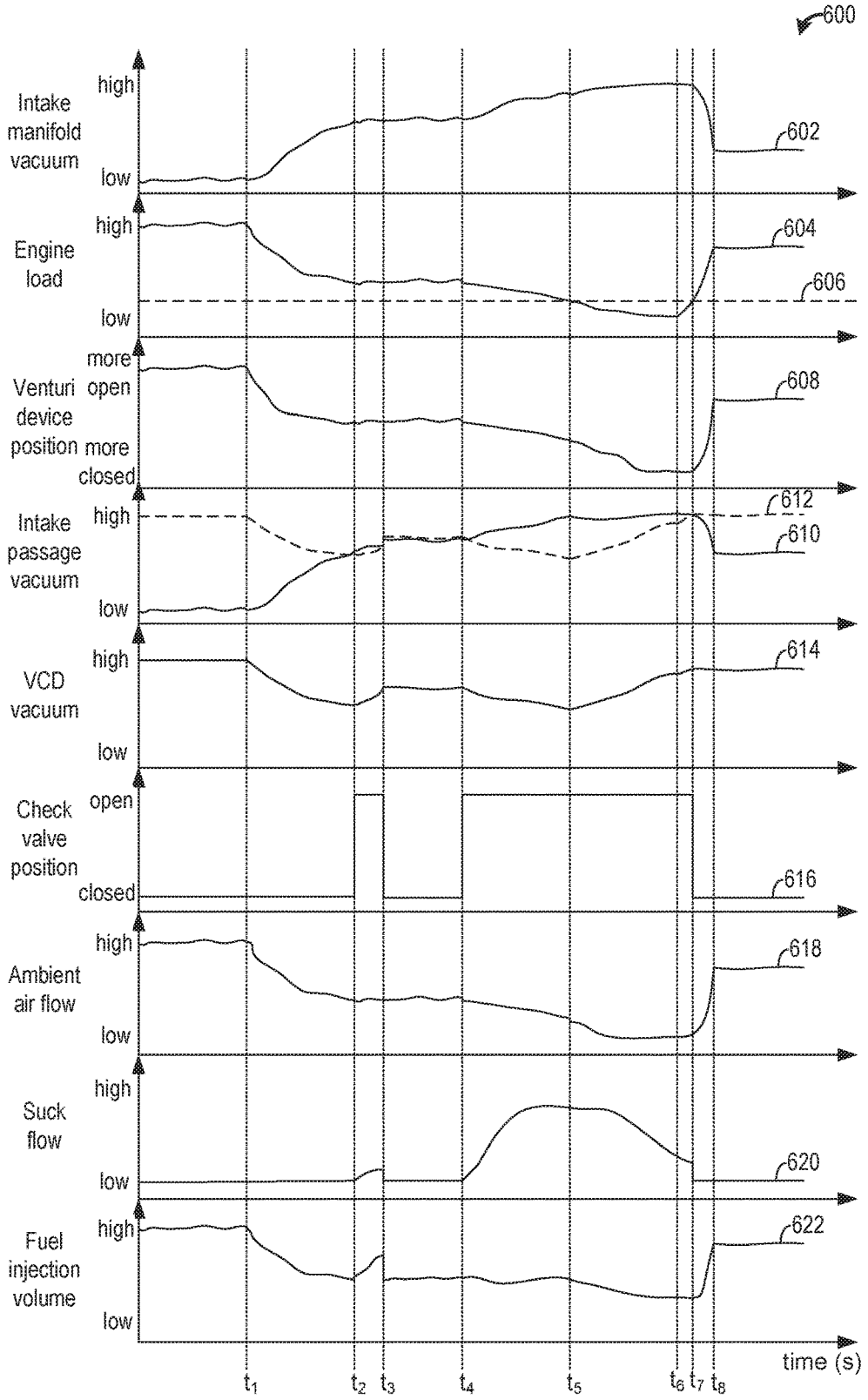
FIG. 6 shows plots depicting exemplary engine adjustments in response to a change in engine load.

The following description relates to systems and methods for generating vacuum in an intake passage and supplying the vacuum from the intake passage to a vacuum consumption device. The intake passage leads to an engine, as shown in FIG. 1. Vacuum may be generated in the intake passage by an annular fixture and a variable venturi device, as shown in FIG. 2. A cross-section showing an interior of the variable venturi device is shown in FIG. 3. The variable venturi device may be associated with the annular fixture during some engine conditions to increase an amount of vacuum generated during some engine conditions. As shown in FIGS. 4A, 4B, and 4C, the venturi device may be moved to an open first position, an intermediate second position, and a closed third position. It will be appreciated by someone skilled in the art that the variable venturi device may also be moved to a plurality of positions located between the open first and closed third positions. FIG. 5 demonstrates a method for actuating the venturi device. FIG. 6 shows a map depicting various engine operating parameters and the relationships of the parameters with one another.

FIGS. 2-4C show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. Furthermore, elements may be described as substantially equal, similar, identical, etc. to one another. Substantially equal, constant, similar, etc. may be described as a deviation between two similar elements being within 1-5% of each other due to manufacturing tolerances.

FIG. 1 shows a schematic depiction of a spark ignition internal combustion engine 10 including an engine intake 11 and an engine exhaust 13, selectively communicating with one or more combustion chambers, of which only one is shown in FIG. 1. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP.

Combustion chamber 30 (also known as cylinder 30) of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system (not shown). Further, a starter motor may be coupled to crankshaft 40 via a flywheel (not shown) to enable a starting operation of engine 10.

Combustion chamber 30 may receive intake air from intake manifold 44 via intake passage 42 and may exhaust combustion gases via exhaust passage 48. Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves.

Engine intake 11 may comprise an intake conduit 95, through which intake gasses are directed to the combustion chamber 30. Thus, engine intake 11 may include intake passage 42, boost chamber 46, and intake manifold 44. The products of combustion may then be expelled from the combustion chamber 30 via opening of exhaust valve 54 to exhaust passage 48.

In this example, intake valve 52 and exhaust valve 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown coupled directly to combustion chamber 30 for injecting fuel directly therein in proportion to the pulse width of signal FPW received from controller 12 via electronic driver 96. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake manifold 44 in a configuration that provides what is known as port injection of fuel into the intake port upstream of combustion chamber 30.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Engine 10 may further include a compression device such as a turbocharger or supercharger including at least a compressor 162 arranged along intake passage 42. For a turbocharger, compressor 162 may be at least partially driven by a turbine 164 (e.g., via a shaft 161) arranged along exhaust passage 48. Compressor 162 draws air from intake passage 42 to supply boost chamber 46. Exhaust gases spin turbine 164 which is coupled to compressor 162 via shaft 161. For a supercharger, compressor 162 may be at least partially driven by the engine and/or an electric machine, and may not include a turbine. Thus, the amount of compression provided to one or more cylinders of the engine via a turbocharger or supercharger may be varied by controller 12.

A wastegate 168 may be coupled across turbine 164 in a turbocharger. Specifically, wastegate 168 may be included in a bypass 166 coupled between an inlet and outlet of the exhaust turbine 164. By adjusting a position of wastegate 168, an amount of boost provided by the turbine may be controlled.

The intake passage 42 may include a throttle 62 having a throttle plate 64. In this particular example, the position of throttle plate 64 may be varied by the controller 12 via a signal provided to an electric motor or actuator included with the throttle 62, a configuration that is commonly referred to as electronic throttle control (ETC). In this manner, the throttle 62 may be operated to vary the intake air provided to the combustion chamber 30 among other engine cylinders. The position of the throttle plate 64 may be provided to the controller 12 by a throttle position signal. The intake passage 42 may include a mass air flow sensor 120 and a manifold air pressure sensor 122 for sensing an amount of air entering engine 10.

Intake manifold 44 is shown communicating with throttle having a throttle body 62 and a throttle valve 64. In this particular example, the position of throttle valve 64 may be varied by controller 12 via a signal provided to an electric motor or actuator included with throttle 60, a configuration that is commonly referred to as electronic throttle control (ETC). Throttle position may be varied by the electric motor via a shaft. Throttle 60 may control airflow from intake boost chamber 46 to intake manifold 44 and combustion chamber 30 among other engine cylinders. The position of throttle valve 64 may be provided to controller 12 by throttle position signal TP from throttle position sensor 65. As such, the position of the throttle valve 64 may be adjusted by the electric motor based on signals received from the controller 12. Said another way, the controller 12 may send signals to the electric motor for adjusting the position of the throttle valve 64.

Engine 10 is coupled to vacuum consumption device 140 which may include, as non-limiting examples, one of a brake booster, a fuel vapor canister, and a vacuum-actuated valve (such as a vacuum-actuated wastegate). Vacuum consumption device 140 may receive vacuum from a plurality of vacuum sources. One source may be variable venturi device 68, located downstream of the boost chamber 46 that may be passively operated via an operation of the engine 10 to supply vacuum to vacuum consumption device 140. Check valve 73 allows air to flow to variable venturi device 70 from vacuum consumption device 140. Another source of vacuum may be fixture 69 positioned downstream of the boost chamber 46.

Fixture 69 is annular with a hollow passage located therein. The venturi device 68 and the fixture 69 may draw air from the vacuum consumption device 140 via conduit 198 during engine operation, where an amount of air may be based on various engine conditions, as described below. Check valve 73 is located along the conduit 198 and may regulate the amount of air based on a vacuum generated by one or more of the variable venturi device 68 and the fixture 69. In some embodiments of the engine 10, the throttle body 62 and throttle valve 64 may be omitted, and where the fixture 69 and venturi device 68 may operate similarly to the throttle 62. In this way, the venturi device 68 may allow less intake air at lower loads and more intake air at higher loads to flow to the engine 10. Operation of the venturi device 68, the fixture 69, and the vacuum consumption device 140 will be described in greater detail below.

Although not shown, an exhaust gas recirculation (EGR) passage may be used with engine 10. An EGR passage outlet may be located downstream of the fixture 69, in one example. In another example, the EGR passage outlet may be fluidly coupled to one or more of the venturi device 68 and the fixture 69. In this way, a vacuum generated may be used to assist EGR flow from the EGR outlet into the intake passage 42.

Exhaust gas sensor 126 is shown coupled to exhaust passage 48 upstream of emission control device 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Emission control device 70 is shown arranged along exhaust passage 48 downstream of exhaust gas sensor 126. Device 70 may be a three way catalyst (TWC), NOx trap, various other emission control devices, or combinations thereof.

An exhaust gas recirculation (EGR) system may be used to route a desired portion of exhaust gas from exhaust passage 48 to intake manifold 44 through conduit 152 via EGR valve 158. Alternatively, a portion of combustion gases may be retained in the combustion chambers, as internal EGR, by controlling the timing of exhaust and intake valves.

Controller 12 is shown in FIG. 1 as a conventional microcomputer including: microprocessor unit 102, input/output ports 104, read-only memory 106, random access memory 108, keep alive memory 110, and a conventional data bus. Controller 12 commands various actuators such as throttle valve 64, EGR valve 158 and the like. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to input device 130 for sensing accelerator position adjusted by vehicle operator 132; a measurement of engine manifold pressure (MAP) from pressure sensor 121 coupled to intake manifold 44; a measurement of boost pressure from pressure sensor 122 coupled to boost chamber 46; a measurement of vacuum in vacuum consumption device 140 from pressure sensor 125, a profile ignition pickup signal (PIP) from Hall effect sensor 118 (or other type) coupled to crankshaft 40; a measurement of air mass entering the engine from mass airflow sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, read-only memory 106 may be programmed with computer readable data representing instructions executable by microprocessor unit 102 for performing the methods described below as well as other variants that are anticipated but not specifically listed. Thus, the computer readable instructions may be stored in non-transitory memory, such as in read-only memory 106, the instructions executable by the microprocessor unit 102 for performing the methods described herein. Example routines are described herein at FIG. 5.

As described above, FIG. 1 merely shows one cylinder of a multi-cylinder engine, and that each cylinder has its own set of intake/exhaust valves, fuel injectors, spark plugs, etc. Also, in the example embodiments described herein, the engine may be coupled to a starter motor (not shown) for starting the engine. The starter motor may be powered when the driver turns a key in the ignition switch on the steering column, for example. The starter is disengaged after engine start, for example, by engine 10 reaching a predetermined speed after a predetermined time.

FIG. 2 shows a perspective view of a vacuum generating system 200 located along an intake passage 202 in an intake pipe 204. The vacuum generating system 200 comprises an annular fixture 220 downstream of a venturi device 250, which may be used as annular fixture 68 and variable venturi device 69 in the embodiment of FIG. 1, respectively. The vacuum generating system 200 may be configured to replenish vacuum in a vacuum consumption device (e.g., vacuum consumption device 140 in the embodiment of FIG. 1).

An axis system 290 includes three axes namely, an x-axis parallel to a horizontal direction, a y-axis parallel to a vertical direction, and a z-axis perpendicular to the x- and y-axes. A "height" of components in the perspective view may be used to define the extent of the components along the y-axis. Similarly a "length" of components in the perspective view may be used to refer to the physical extent of the components along the x-axis. The extent of the components along the z-axis may be referred to as a "width." Cutting plane M-M' defines the cross-section view of the vacuum generating system shown in FIG. 3. Arrow 298 depicts a general direction of incoming intake air flow through the intake passage 202. Arrow 299 depicts a direction of a force of gravity.

Dashed line 295 represents an axis, which may be a central axis of the intake pipe 204 and/or the venturi device 250. The annular fixture 220 is radially spaced away from the central axis 295 while the venturi device 250 is located along the central axis 295. Incoming intake air flows substantially parallel to the central axis 295 (or the x-axis for example).

The annular fixture 220 and the venturi device 250 are separate components located along different portions of the intake passage 202. The annular fixture 220 and/or the venturi device 250 may be single, contiguous, and hollow machined components. The annular fixture 220 and/or the venturi device 250 may be composed of one or more of a ceramic material, a metal alloy, a silicon derivative, polyurethane, or other suitable materials. In some examples, the annular fixture 220 and/or the venturi device 250 may comprise of materials similar to a compositional make-up of the intake pipe 204.

The annular fixture 220 includes a sealing surface 226 that is flush with and/or in sealing contact with interior surfaces of the intake pipe 204. In one example, the sealing surface 226 is in sealing contact with an entire inner circumference of the intake pipe 204. Thus, a cross-section of the sealing surface 226 is substantially equal to a cross-section of the intake pipe 204, where both cross-sections are circular. Thus, intake air flowing through the intake passage 202 may not flow between the sealing surface 226 and the intake pipe 204. Further, the sealing surface 226 may physically couple the annular fixture 220 to the intake pipe 204 such that the annular fixture 220 may not be displaced along the central axis 295 and/or rotated about the central axis 295. As such, the annular fixture 220 is fixed in one example.

The annular fixture 220 is curved and extends inwards towards the central axis 295 of the intake pipe 204. In this way, a cross-sectional flow area through the intake passage 202 may be smaller at the annular fixture 220 than at portions of the intake passage 202 not including the annular fixture 220. In one example, a central intake passage 206 traverses through an entire length of the annular fixture 220, with a cross-sectional flow through area of the central intake passage 206 fluctuating based on a shape of the annular fixture 220, as will be described below. The annular fixture 220 includes a first surface 232 facing incoming intake gas flow. The first surface 232 may be angled relative to arrow 298 indicating a direction of incoming intake gas flow. A second surface 234 faces away from incoming intake gas flow. The second surface 234 may also be angled relative to the direction of incoming intake gas flow. The first surface 232 is upstream of the second surface 234 relative to incoming intake gas flow.

Thus, the first surface 232 and the second surface 234 may define a curvature of the annular fixture 220, where an apex 236 of the annular fixture 220 is formed where the first surface 232 and the second surface 234 meet (intersect, for example). Said another way, the annular fixture 220 is radially spaced away from the central axis 295, with a maximum radial distance being located at an upstream outer edge 222 and a downstream outer edge 224, and a minimum radial distance associated with the apex 236. Thus, the apex 236 may be the most inwardly projecting portion of the annular fixture 220 and is the portion of the annular fixture 220 positioned farthest from surfaces of the intake pipe 204, to which the annular fixture 220 is in contact with. Conversely, the outer edges 222 and 224 may be the least inwardly projecting portions of the annular fixture 220 and are the portions of the annular fixture 220 positioned nearest to surfaces of the intake pipe 204. In one example, the outer edges 222 and 224 are flush with surfaces of the intake pipe 204. In some embodiments, the central intake passage 206 functions similarly to a venturi passage, where vacuum may be generated within the central intake passage 206 as intake gas flows by the annular fixture 220.

Cross-sections of the annular fixture 220 taken along planes defined by the y- and z-axes, may be substantially equal in the horizontal direction (along the x-axis, for example). Therefore, the annular fixture 220 is symmetric and apex 236 may not be a single point, but may instead extend along an entire interior circumference of the annular fixture 220. Thus, the apex 236 is annular and uniformly traverses the interior circumference of the annular fixture 220. In some examples, the apex 236 may not be uniform and the annular fixture 220 may be asymmetric.

A plurality of apertures 238 are equidistantly located along an entire circumference of the apex 236. Said another way, the apex 236 is perforated via the apertures 238, which may fluidly couple a vacuum consumption device 140 to the central intake passage 206. As such, a distance between a first aperture and a second adjacent aperture may be substantially equal to a distance between a third aperture and a fourth aperture adjacent the third aperture or the apertures 238. A hollow shaft 240 fluidly couples the vacuum consumption device 140 to an interior space of the annular fixture 220 such that air may flow from the vacuum consumption device 140, through the annular fixture 220, out the apertures 238, and into the central intake passage 206. This air flow from the vacuum consumption device 140 to the central intake passage 206 may be promoted by vacuum generated in the central intake passage 206. The vacuum may be supplied to the interior space of the annular fixture 220 via the apertures 238. By doing this, vacuum is replenished to the vacuum consumption device 140. Air flow from the vacuum consumption device 140 along with vacuum generation in the central intake passage 206 will be described in greater detail below.

In some embodiments, additionally or alternatively, the apex 236 may be a single, contiguous opening. It will be further appreciated that the apertures 238 may be located along the first surface 232 or the second surface 234 without departing from the scope of the present disclosure. The apertures 238 may be oriented similarly along the apex 236. In one example, each aperture of the apertures 238 is circular. It will be appreciated that the apertures 238 may be other suitable shapes without departing from the scope of the present disclosure, for example, the apertures 238 may be oblong, triangular, square, rectangular, star-shaped, etc.

As will be explained in greater detail below with reference to FIGS. 4A-4C a venturi device 250 may be movable along the central axis 295 parallel to arrow 298. Thus, the venturi device 250 may slide relative to the intake pipe 204. The venturi device 250 may slide in an upstream direction against incoming intake gas or in a downstream direction with incoming intake gas. The venturi device 250 may be displaced along the central axis 295 to adjust an amount of vacuum generated between the annular fixture 220 and the venturi device 250.

The venturi device 250 is hollow and annular. The venturi device 250 is teardrop-shaped in one example. The venturi device 250 may be eggplant-shaped, oblong, spherical, football-shaped, egg-shaped, pear-shaped, torpedo-shaped, barrel shaped, or other suitable shapes in other examples. Thus, cross-sections of the venturi device 250 along planes defined by the y- and z-axes are substantially equal along the x-axis. As such, the venturi device 250 is symmetric.

The venturi device 250 is curved and may extend outwards towards the intake pipe 204 from the central axis 295. Thus, a cross-sectional flow area of the intake passage may be smaller at the venturi device 250 than at portions of the intake passage 202 not including the venturi device 250. In one example, the venturi device 250 is radially spaced away from the intake pipe 204, and where a radial space between the venturi device 250 and the intake pipe 204 defines an outer intake passage 208. As such, the outer intake passage 208 surrounds the venturi device 250. The outer intake passage 208 is upstream of the central intake passage 206, and the outer intake passage 208 may comprise a cross-sectional flow area corresponding to the radial distance between the venturi device 250 and the intake pipe 204.

In one example, a smallest cross-sectional flow through area of the outer intake passage 208 may be less than a smallest cross-sectional flow through area of the central intake passage 206. Thus, a vacuum generated in the outer intake passage 208 may be greater than a vacuum generated in the central intake passage 206. In some examples, the smallest cross-sectional flow through areas of the outer 208 and central 206 intake passages may be substantially equal such that vacuum generated in the passages is also substantially equal. In other examples, the smallest cross-sectional flow through area of the central intake passage 206 may be less than the smallest cross-sectional flow through area of the outer intake passage 208. This may allow the central intake passage 206 to generate a greater vacuum than a vacuum generated in the outer intake passage 208 as ambient air flows through passages at a given engine load.

In one example, the outer intake passage 208 may be a first venturi passage and the central intake passage 206 may be a second venturi passage. The passages may merge upon displacing the venturi device 250 in the downstream direction. As will be described below, the first venturi passage and the second venturi passage may completely merge such that a single venturi passage is located between the annular fixture 220 and the venturi device 250.

The venturi device 250 includes an upstream first surface 252 facing incoming intake gas flow. The upstream first surface 252 may be angled relative to arrow 298. The upstream first surface 252 comprises an opening 282 for receiving a shaft 280 at an upstream end. The shaft 280 and the opening 282 are located along the central axis 295. In one example, the opening 282 is symmetrically located about the central axis 295. A downstream second surface 254 may be further included in the venturi device 250, and may face away from incoming intake gas flow. The downstream second surface 254 may also be angled relative to arrow 298. In one example, the upstream first surface 252 and the downstream second surface 254 may be angled oppositely to one another. The downstream second surface 254 is closed with a tip and/or point 258 of the downstream second surface 254 pointing away from incoming intake air flow (or toward the annular fixture 220, for example). In one example, the tip 258 is located directly along the central axis 295. The upstream first surface 252 and the downstream second surface 254 will be described in greater detail below. Thus, the upstream first surface 252 and the downstream second surface 254 may define the curvature of the venturi device 250. An apex 256 may form where the upstream first surface 252 and the downstream second surface 254 meet (intersect). The apex 256 may be the most outwardly projecting portion of the venturi device 250. Said another way, the apex 256 may be the portion of the venturi device 250 positioned nearest to the intake pipe 204, forming a narrowest (smallest) cross-sectional flow through area of the outer intake passage 208. Thus, the apex 256 may extend around an entirety of the greatest circumference of the venturi device 250. However, in some examples, the apex 256 may only extend around a portion of the venturi device 250.

The venturi device 250 further comprises a plurality of perforations 260 located around a circumference of the venturi device 250 between the apex 256 and the tip 258. As shown, the perforations 260 are located closer to the apex 256 than the tip 258. In some examples, additionally or alternatively, the perforations 260 may be located exactly between the apex 256 and the tip 258 or closer to the tip 258. The perforations 260 may be equidistantly spaced away from each other such that a distance between a first perforation and a second perforation adjacent the first of the perforations 260 is equal to a distance between the second perforation and a third perforation adjacent the second of the perforations 260. The perforations 260 are circular in one example. In other examples, the perforations 260 may be oblong, elliptical, triangular, square, rectangular, or other suitable shapes.

The perforations 260 may allow air to flow from the vacuum consumption device 140 to the outer intake passage 208. Air may flow from the vacuum consumption device 140, through the shaft 280, into an interior space of the venturi device 250, out the perforations 260, and into the outer intake passage 208. Air flow from the vacuum consumption device 140, through the venturi device 250, and into the outer intake passage 208 may be promoted by a vacuum generated in the outer intake passage 208. The vacuum may be supplied to the interior space of the venturi device 250 via the perforations 260, where the vacuum may draw air out of the vacuum consumption device 140 thereby replenishing a stored vacuum of the vacuum consumption device 140.

In one example, as intake air flows through the intake passage 202, it flows through the outer intake passage 208 and the central intake passage 206 before flowing to the intake manifold (intake manifold 44 in the embodiment of FIG. 1). The outer intake passage 208 and the central intake passage 206 may generate vacuum. By doing this, the vacuum from the two passages may combine and replenish a vacuum of the vacuum consumption device 140. In one example, the vacuum may only be supplied to the vacuum consumption device 140 if the vacuum is greater than a threshold vacuum, where the threshold vacuum is based on a vacuum stored in the vacuum consumption device. Said another way, the vacuum generated in the two passages may be supplied to the vacuum consumption device if the vacuum generated is able to increase an amount of vacuum stored in the vacuum consumption device 140. Vacuum supplied to the vacuum consumption device may be regulated by a valve, as will be described below.

Thus, the vacuum consumption device comprises a venturi device upstream of an annular fixture. The venturi device is located along a center of an intake pipe and the annular fixture is sealed to an interior surface of the intake pipe. The venturi device is sized and shaped such that a first venturi passage is located between the venturi device and an intake pipe. Likewise, the annular fixture is sized and shaped such that a second venturi passage is located between the annular fixture and a central axis of an intake pipe. Thus, a cross-sectional flow through area of an intake passage decreases at both the first and second venturi passages.

Vacuums may be generated in the first venturi passage and the second venturi passage as intake gas flows passed the venturi device and the annular fixture, respectively. The vacuum in the first venturi passage may draw air from the vacuum consumption device. The vacuum in the second venturi passage may also draw air from the vacuum consumption device. Air from the first venturi passage may flow downstream and mix with air in the second venturi passage. Furthermore, the venturi device may be displaced along the intake passage to and away from the annular fixture to adjust both an amount of vacuum provided to the vacuum consumption device and a mass of intake air flowing through the intake passage to an intake manifold. Thus, the actuation of the venturi device to and away from the annular fixture may function similarly to a throttle (e.g., throttle 62 of FIG. 1). By doing this, a stored vacuum of the vacuum consumption device may be replenished.

It will be appreciated that the venturi device may be coupled to a first vacuum consumption device and the annular fixture may be coupled to a second vacuum consumption device different than the first vacuum consumption device. In other examples, one or more of the venturi device and the annular fixture may be coupled to an EGR outlet of an EGR system. This may allow EGR to mix with intake gas before flowing to an intake manifold of an engine.

FIG. 3 shows a cross-sectional view 300 of the intake pipe 204 and the vacuum generating system 200, where the cross-sectional plane is taken along line M-M' of FIG. 2. As such, components previously presented may be similarly numbered in subsequent figures.

In the embodiment of FIG. 3, the venturi device 250 is shown interior to the annular fixture 220 with a tip 258 of the venturi device extending downstream of the apex 236. In one example, a cross-section taken along the y-axis at the tip 258 may include portions of the second surface 234 of the annular fixture 220. Furthermore, a cross-section taken along the y-axis at the apex 256 of the venturi device 250 may include portions of the first surface 232. In some examples, a cross-section taken along the y-axis at the opening 282 of the upstream first surface 252 (the interface between the shaft 280 and the upstream first surface 252, for example) may include a portion of the first surface 232. As such, a cross-section taken along the y-axis at any portion of the venturi device 250 may include at least some overlap between the venturi device 250 and the annular fixture 220. In this way, the central intake passage 206 and the outer intake passage 208 may combine to form a single passage located between the annular fixture 220 and the venturi device 250 when the venturi device 250 is located interior to the annular fixture 220, in some examples. It will be appreciated by someone skilled in the art that the venturi device 250 may be moved to other upstream and downstream locations such that a distance between the venturi device 250 and the annular fixture 220 may be different than the distance depicted in the embodiment of FIG. 3.

As described above, the annular fixture 220 comprises the sealing surface 226 in contact with the intake pipe 204 and first 232 and second 234 surfaces protruding into the intake passage 202. An annular chamber 302 is located interior to the sealing surface 226, the first surface 232, and the second surface 234. In one example, the first 232 and second 234 are the only surfaces separating the annular chamber 302 from the intake passage 202. As shown, a majority of the interior space of the annular fixture 220 is not hollow. As such, a volume of the annular chamber 302 may be relatively small compared to a total volume of the annular fixture 220. The annular chamber 302 extends around an entire circumference of the apex 236. By doing this, the annular chamber 302 is fluidly coupled to the narrowest portion of the central intake passage 206. In one example, a height of the annular chamber 302 is greatest at the portion of the annular chamber 302 fluidly coupled to the shaft 240. As such, the sealing surface 226 comprises an opening for allowing the annular chamber 302 to be fluidly coupled with the shaft 240. In some examples, additionally or alternatively, the annular chamber 302 may be located on the first surface 232 or the second surface 234. Specifically, the annular chamber 302 may be located on the second surface 234 directly downstream of the apex 236, as an example.

Air may flow from the vacuum consumption device 140, through a first passage 342, through a second passage 344, through the shaft 240, and into the annular chamber 302 when a valve 340 is in an at least partially open position. The valve 340 is a spring actuated check valve, in one example. Furthermore, the valve 340 is mechanically actuated is not coupled to any electrical devices, as an example. The valve 340 may open or close based on a vacuum supplied to the annular chamber 302. If the vacuum is greater than the threshold vacuum, then the vacuum may move the valve 340 to a more open position. This allows air to flow from the vacuum consumption device 140 to the central intake passage 206. By flowing air in this way, a vacuum level in the vacuum consumption device 140 may be replenished. As described above, the threshold vacuum may be based on an amount of vacuum stored in the vacuum consumption device 140. In one example, the valve 340 may only open in response to a vacuum level capable of increasing an amount of vacuum stored in the vacuum consumption device 140. Said another way, the valve 340 may prevent loss of vacuum from the vacuum consumption device 140 to the intake passage 202. It will be appreciated that the vacuum consumption device 140 may be sealed from the intake passage 202 if a vacuum of the vacuum consumption device 140 is greater than a vacuum in the intake passage 202.

As described above, the first 232 and second 234 surfaces of the annular fixture 220 are curved relative to the direction of flow of intake gases (which is parallel to arrow 298, for example). Specifically, the first surface 232 may be oriented at approximately a first angle $\theta_1$, relative to arrow 298, and the second surface 234 may be oriented approximately at a second angle $\theta_2$, relative to the arrow 298. As shown, first angle $\theta_1$ may be larger than second angle $\theta_2$. Said another way, the slope of the first surface 232 may be greater than the slope of the second surface 234. However, it should be appreciated that in other examples, the angles $\theta_1$ and $\theta_2$ may be approximately the same, and therefore the annular fixture 220 may be relatively symmetric about the apex 236. In still further examples, second angle $\theta_2$ may be greater than first angle $\theta_1$ such that the slope of the first surface 232 may be less than the slope of the second surface 234.

The venturi device 250 is hollow and comprises an interior chamber 350 located between the upstream first surface 252 and the downstream second surface 254. The interior chamber 350 may occupy an entire volume of the interior space of the venturi device 250, in one example. In other examples, the interior chamber 350 may comprise a volume less than the volume of the interior space such that the venturi device 250 is only partially hollow. The interior chamber 350 is fluidly coupled to the outer intake passage 208 via the plurality of perforations 260. As described above, the perforations 260 are located on the downstream second surface 254 directly downstream of (or adjacent to, for example) the apex 256 of the venturi device 250. Thus, the interior chamber 350 is fluidly coupled to the portion of the outer intake passage 208 directly downstream of the narrowest portion of the outer intake passage 208. In one example, the first upstream surface 252 and the second downstream surface 254 are the only surfaces separating the interior chamber 350 from the intake passage 202.

Air may flow from the vacuum consumption device 140, through the first passage 342, through a second passage 344, through a third passage 346, through the shaft 280, and into the interior chamber 350 when the valve 340 is in an at least partially open position. As shown, the second passage 344 is fluidly coupled to both the shaft 240 and the third passage 346. In some examples, the second passage 344 and the third passage 346 may be a single contiguous passage. An amount of air flowing from the second passage 344 to the shaft 240 or the third passage 346 may be based on an amount of vacuum supplied to the annular chamber 302 or the interior chamber 350, respectively. As such, a greater amount of vacuum supplied may draw more air into a corresponding passage. As an example, if the interior chamber 350 receives a greater amount of vacuum from the outer intake passage 208 than the annular chamber 302 receives from the central intake passage 206, then more air from the vacuum consumption device 140 flows into the interior chamber 350 than the annular chamber 302. Additionally or alternatively, in some examples, the interior chamber 350 and the annular chamber 302 may receive substantially equal vacuums from the outer 208 and central 206 intake passages such that the chambers receive substantially equal amounts of air from the vacuum consumption device 140.

The upstream first 252 and the downstream second 254 surfaces of the venturi device 250 are curved relative to the direction of flow of intake gases. Specifically, the upstream first surface 252 may be oriented at approximately a third angle $\theta_3$, relative to arrow 298, and the downstream second surface 254 may be oriented approximately at a fourth angle $\theta_4$, relative to the arrow 298. As shown, the third angle $\theta_3$ may be larger than the fourth angle $\theta_4$. Said another way, the slope of the upstream first surface 252 may be greater than the slope of the downstream second surface 234. However, it should be appreciated that in other examples, the angles $\theta_3$ and $\theta_4$ may be approximately the same, and therefore the venturi device may be relatively symmetric about the apex 256. In still further examples, the fourth angle $\theta_4$ may be greater than the third angle $\theta_3$ such that the slope of the upstream first surface 252 may be less than the slope of the downstream second surface 254.

In one example, additionally or alternatively, one or more of the angles $\theta_1$, $\theta_2$, $\theta_3$, and $\theta_4$ may be equal such that a curvature of the surfaces of the annular fixture 220 may be substantially similar to a curvature of the surfaces of the venturi device 250.

As described above, the venturi device 250 may be displaced relative to the intake pipe 204 and annular fixture 220. The venturi device 250 may be actuated based on one or more of an ambient pressure or an intake manifold pressure, as will be described below. Thus, in one example, the venturi device 250 is not coupled to any electrical components. As such, one or more of the second passage 344 and the third passage 346 may be composed of a flexible hose, which may flexibly extend and contract based on a movement of the venturi device 250. An outer surface of the shaft 280 may be coupled to a first upstream bushing 380 and a second downstream bushing 382. The shaft 280 extends through openings of the bushings 380 and 382, allowing the shaft 280 to move along with the movement of the venturi device 250. The bushings 380 and 382 are coupled to the shaft 280 adjacent the central axis 295 and are physically coupled to the intake pipe 204 via outer ends. Thus, the bushings 380 and 382 do not move, in one example.

A spring 384 is physically coupled to the first bushing 380 and the third passage 346. The spring 384 may be biased to a fully extended position (as shown in the example of FIG. 4A) in one example. As another example, the spring 384 may be biased to a fully compressed position (as shown in the example of FIG. 4C). As an ambient pressure increases and/or as an intake manifold pressure decreases, the spring 384 may be compressed, allowing the venturi device 250 to move toward the annular fixture 220. The spring 384 may assist movement of the venturi device 250 in one or more of the upstream and downstream directions to prevent noises emanating from the intake passage 202, in one example. The spring 384 and movement of the venturi device 250 along with example air flows will be described in greater detail below with respect to FIGS. 4A, 4B, and 4C.

FIGS. 4A, 4B, and 4C show example positions to which the venturi device 250, of the vacuum generating system 200, may be adjusted along with example air flows through the venturi device 250, the annular fixture 220, and the intake passage 202. Thus, FIGS. 4A, 4B, and 4C show relative positioning of the venturi device 250 within the intake pipe 204, as the venturi device 250 is adjusted to different example positions. FIGS. 4A, 4B, and 4C show cross-sectional views of the intake pipe 204 and the vacuum generating system 200, where the cross-sectional plane is taken along line M-M' of FIG. 2. FIG. 4A shows the venturi device 250 in an open first position, similar to the position of the venturi device in FIG. 3. FIG. 4B shows the venturi device 250 in an intermediate second position. FIG. 4C shows the venturi device 250 in a closed third position. More intake gas may flow to an intake manifold (e.g., intake manifold 44 of FIG. 1) when the venturi device 250 is in the first open position than in the closed second position.

In FIGS. 4A, 4B, and 4C, the venturi device 250 may be shown displaced along the central axis 295 in different positions. As described above, the venturi device 250 may slide relative to the annular fixture 220 and intake pipe 204 along the central axis 295. As such, the distance between the venturi device 250 and the annular fixture 220 may vary depending on the position of the venturi device 250. Specifically, when adjusting the venturi device 250 to a more open position, the venturi device 250 may be moved away from to annular fixture 220. In this way, an opening in the intake passage 202 formed between the venturi device 250 and the annular fixture 220 may be increased, and airflow there-through may correspondingly increase, as will be described below. Further, when adjusting the venturi device 250 to a more closed position, the venturi device 250 may be moved closer to the annular fixture 220. In this way, an opening in the intake passage 202 formed between the venturi device 250 and the annular fixture 220 may be reduced and/or closed, and airflow there-through may correspondingly decrease. In one example, as the venturi device 250 is adjusted toward the more closed position, a Venturi effect created between the venturi device 250 and the annular fixture 220 may increase. As such, a larger vacuum may be generated between the venturi device 250 and the annular fixture 220. This may replenish a vacuum of the vacuum consumption device more rapidly than the venturi device 250 being in the more open position.

Since airflow through the intake passage 202 may be substantially parallel to the x-axis, movement of the venturi device 250 may be substantially parallel to intake gas flow in the intake passage 202. Intake air flow is shown flowing from left to right in FIGS. 4A, 4B, and 4C (parallel to arrow 298, for example). As such, moving the venturi device 250 downstream may refer to moving the venturi device 250 in the same or similar direction as intake air flow. Conversely, moving the venturi device 250 upstream may refer to moving the venturi device 250 in the opposite direction of intake gas flow (from right to left in FIGS. 4A, 4B, and 4C). As such, when the venturi device 250 is moved towards a more closed position, it moves in the downstream direction parallel to intake air flow. Thus, the venturi device 250 moves against (opposite to) intake air flow when moving towards a more open position.

The position of the venturi device 250 may be adjusted based on an engine operation. Specifically, the venturi device 250 may move based on one or more of an ambient pressure and an intake manifold pressure. As an example, the venturi device 250 may move in the upstream direction if the intake manifold pressure is greater than a threshold pressure. Conversely, the venturi device 250 may move in the downstream direction if the intake manifold pressure is less than a threshold pressure. Additionally or alternatively, the venturi device 250 may move in the upstream direction if the ambient pressure is less than the intake manifold pressure, in one example.

Additionally or alternatively, the venturi device 250 may be adjusted by a motor. The motor may be electrically coupled to the venturi device 250 for moving the venturi device 250 within the intake pipe 204. The motor may be in electrical communication with controller 12, and may adjust the position of the venturi device 250 based on signals received from the controller 12. Specifically in response to increase in demand for vacuum from the vacuum consumption device, the controller 12 may send signals to the motor for adjusting the position of the venturi device 250 to a more closed position to increase an amount of vacuum generated between the venturi device 250 and the annular fixture 220. The motor may be any suitable actuator such as hydraulic, electric, pneumatic, electromechanical, etc.

FIG. 4A shows an embodiment 400 comprising the venturi device 250 in the open first position and further depicting example airflows through the intake passage 202. Airflow through the intake passage 202 to the intake manifold 44 may be greater with the venturi device 250 in the open first position than any other venturi device position, in one example. Thus, the position of the venturi device 250 shown in FIG. 4A may be referred to as a fully open position and may correspond to a high engine load, in one example. A venturi passage 402, located between the venturi device 250 and the annular fixture 220, may include the central intake passage 206 and the outer intake passage 208 described above. Specifically, the venturi passage 402 may be located along a constriction of the intake passage 202 adjacent the venturi device 250 and the annular fixture 220. The venturi device 250 may not touch the annular fixture 220. More precisely, surfaces of the venturi device 250 do not contact and/or physically touch surfaces of the annular fixture 220 when in the fully open position. The venturi device 250 is overlapped with the annular fixture 220 such that a cross-section of the venturi device 250 and the annular fixture 220 taken along the y-axis may comprise both the venturi device 250 and the annular fixture 220. In some examples, the venturi device 250 may not overlap at all with the annular fixture 220 when the venturi device 250 is in the fully open position (as shown in FIG. 2, for example).

As an example, the fully open position may correspond to higher engine loads where a pressure of the intake manifold is significantly greater than an ambient pressure by a threshold difference. The spring 384 is fully extended in the fully open position. The threshold difference may be based on a pressure needed to move the venturi device 250 to the fully open position. Intake manifold pressures greater than an ambient pressure by less than the threshold difference may move the venturi device 250 to an intermediate second position, as will be described in FIG. 4B. As such, intake manifold pressures less than the ambient pressure may move the venturi device to a closed third position, as will be described below in FIG. 4C. In the fully open position, the spring 384 is fully extended to allow a greatest mass of air to flow through the intake passage 202. In this way, a narrowing of the intake passage 202 may be less in the open first position than in more closed positions, and airflow through the intake passage 202 may be relatively unobstructed. In such an example, the central intake passage 206 and the outer intake passage 208 may be maximally separated such that a space between the venturi device 250 and the annular fixture 220 is greater than other positions of the venturi device 250. This allows an air/fuel ratio to be met during high engine loads.

By positioning the venturi device 250 in this way, a vacuum generated in the outer 208 and central 206 intake passages may be less than a vacuum generated in other positions of the venturi device 250. Thus, air flow from the vacuum consumption device 140 to the intake passage 202 may be less in the fully open position than in other positions of the venturi device 250. As such, the vacuum generated in the venturi passage 402 may not be sufficient to urge the valve 340 to an open position. As such, the valve 340 may remain in a closed position, prohibiting the flow of air from the vacuum consumption device 140 to both the annular fixture 220 and the venturi device 250. Thus, air does not flow through the first passage 342, second passage 344, or third passage 346 when the venturi device 250 is in the fully open position. In this way, vacuum in the vacuum consumption device 140 may not be replenished for a vehicle in a high load and is fluidly sealed from the intake passage 202.

It will be appreciated that in some embodiments, the vacuum generating system 200 may generate a vacuum when the venturi device 250 is in the fully open position. Thus, the valve 340 may be at least partially open such that vacuum from the venturi passage 402 may be provided to the vacuum consumption device 140. In this way, vacuum may be generated for all positions of the venturi device 250, as an example.

FIG. 4B shows an embodiment 425, where the venturi device 250 is displaced downstream in the intake passage 202 along the central axis 295, relative to the open first position shown in FIG. 4A to an intermediate second position. As such, a space between the venturi device 250 and the annular fixture 220 may be smaller than the space in the open first position, and airflow through the intake passage 202 may be correspondingly less as shown by fewer ambient air arrows (shown by solid line arrows). However, an amount of vacuum generated in the venturi passage 402 adjacent the apertures 238 and perforations 260 may be greater than in the intermediate second position than the open first position. As shown, air flows from the vacuum consumption device 140 to both the venturi device 250 and annular fixture 220. Air flow from the vacuum consumption device 140 is shown by dashed line arrows. Furthermore, a greater portion of the venturi device 250 overlaps with the annular fixture 220 than in the first open position. As such, the spring 384 is more compressed in the intermediate second position than in the fully open first position in the example of FIG. 4A. It will be appreciated that the intermediate second position shown is an example intermediate position and the venturi device 250 may be moved to positions between the first open position and the third closed position. In one example, the intermediate second position may correspond to an engine load between a high engine load and a low engine load and/or idle. An intake manifold pressure may be dependent on engine load. As such, for an engine load closer to the high engine load, the intermediate position may be nearer to the first open position. Conversely, for an engine load closer to the low engine load, the intermediate position may be nearer to the third closed position.

In the intermediate second position, the valve 340 is open and air may flow out of the vacuum consumption device 140. A portion of air from the vacuum consumption device 140 flows through the first passage 342, through the valve 340, through the second passage 344, through the shaft 240, into the annular chamber 302 of the annular fixture 220, through the apertures 238, through an outlet of the venturi passage 402, and into the intake passage 202 where the air flows to the intake manifold 44. A remaining portion of air from the vacuum consumption device 140 flows through the first passage 342, through the valve 340, through the second passage 344, through the third passage 346, through the shaft 280, into the interior chamber 350 of the venturi device 250, through the perforations 260, and into a throat of the venturi passage 402 before flowing through the intake passage 202 to the intake manifold 44. Air from the venturi device 250 may mix with air from the annular fixture 220 in the venturi passage 402 before flowing to the intake manifold 44. As described above, the portions of air flowing from the vacuum consumption device 140 to the annular fixture 220 and the venturi device 250 may be based on a vacuum supplied to the annular chamber 302 and the interior chamber 350, respectively.

FIG. 4C shows an embodiment 450, where the venturi device 250 is displaced downstream in the intake passage 202 along the central axis 295, relative to the open first position shown in FIG. 4A and the intermediate second position shown in FIG. 4B to the closed third position. As such, a space between the venturi device 250 and the annular fixture 220 may be smaller than the space in the intermediate second position, and airflow through the intake passage 202 may be substantially zero as shown by the absence of ambient air arrows. Thus, vacuum is not generated in the venturi passage due to ambient air flow. As shown, air flows from the vacuum consumption device 140 to both the venturi device 250 and annular fixture 220. Air flow from the vacuum consumption device 140 is shown by dashed line arrows. Furthermore, a greater portion of the venturi device 250 overlaps with the annular fixture 220 than in the first open position. As such, the spring 384 is more compressed in the closed third position than in the intermediate second position in the example of FIG. 4B. In one example, the spring 284 may be in a fully compressed position.

In the closed third position, the apex 256 of the venturi device 250 touches a portion of the first surface 232 of the annular fixture 220 located directly upstream of the apex 236. The apex 256 may be in sealing contact with the first surface such that substantially no ambient air flows to the intake manifold 44 from the intake passage 202 when the venturi device 250 is in the fully closed position. Although vacuum is not generated in the venturi passage 402 due to the sealed contact between the venturi device 250 and the annular fixture 220, vacuum may still be provided to the annular chamber 302 and the interior chamber 350. The vacuum may be supplied from the intake manifold due to a low pressure (increased vacuum, for example) of the intake manifold. Thus, the third closed position may correspond with a low load and/or idle condition of the engine. As shown, the apertures 238 and the perforations 260 are exposed to the intake manifold 44 side of the intake passage 202, allowing the vacuum to promote air to flow from the vacuum consumption device 140 to the intake passage 202.

In one example, more vacuum may be supplied to the vacuum consumption device 140 than in other positions of the venturi device 250. As such, more air may flow from the vacuum consumption device 140 than in other positions of the venturi device 250, as shown by a greater number of dashed line arrows. In some examples, the air flow in the closed third position may maintain an engine idle. In this way, when the engine is in idle, an air/fuel ratio may be met while providing vacuum to the vacuum consumption device 140.

Thus, FIGS. 4A, 4B, and 4C illustrate various positions of a venturi device for adjusting a vacuum provided to a vacuum consumption device. A method for adjusting the venturi device may include adjusting the venturi device to an open first position, an intermediate second position, or a closed third position. The open first position includes moving the venturi device in an upstream direction against a direction of air flow away from an annular fixture and decreasing a vacuum provided to the vacuum consumption device. The closed third position includes moving the venturi device in a downstream direction with the direction of air flow towards the annular fixture and increasing an amount of vacuum provided to the vacuum consumption device. The intermediate second position includes moving the venturi device to a location between the open first position and the closed third position. Adjusting the venturi device to the closed third position further comprises touching an apex of the venturi device to a first surface of the annular fixture directly upstream of apertures of the fixture, and where the closed third position further includes flowing more air from the vacuum consumption device to an intake passage than other positions of the venturi device. Adjusting the venturi device to the open first position further comprises increasing a space between the venturi device and the annular fixture, and where the open first position further includes flowing less air from the vacuum consumption device to an intake passage than other positions of the venturi device.

As such, moving the venturi device in the upstream direction away from the annular fixture increases ambient air flow to an intake manifold and decreases vacuum provided to the vacuum consumption device thereby decreasing air flow from the vacuum consumption device to the intake manifold. Conversely, moving the venturi device in the downstream direction to the annular fixture decreases ambient air flow to the intake manifold and increases vacuum provided to the vacuum consumption device thereby increasing air flow from the vacuum consumption device to the intake manifold.

FIG. 5 shows a method 500 that a controller (controller 12 of FIG. 1, for example) may perform to adjust a fuel injection (by adjusting a fuel injector (fuel injector 52 of FIG. 1, for example) in response to adjusting a position of a venturi device (venturi device 250 of FIGS. 2-4C, for example). Additionally, the controller may modify one or more engine operating parameters responsive to the adjusting of the venturi device to maintain an air/fuel ratio or other engine conditions, such as, engine torque, in one example.

As described above, the venturi device may be moved away from or toward the annular fixture such that an amount of air provided to an engine is adjusted. For example, as the venturi device moves away from the annular fixture, more ambient air may flow to the engine while less suck air (air from a vacuum consumption device, for example) flows to the engine. Conversely, as the venturi device moves toward the annular fixture, less ambient air may flow to the engine while more suck air flows to the engine. In some examples, suck air flow may not change as the venturi device is adjusted due to a vacuum of the vacuum consumption device being greater than a vacuum in an intake passage.

At 502, engine operating conditions may be determined. Engine operating conditions may include engine speed, torque demand, air/fuel ratio, boost pressure, manifold absolute pressure, mass airflow, engine temperature, etc. Once engine operating conditions are estimated, method 500 proceeds to 504 to adjust the venturi device based on an engine load. As described above, the venturi device is adjusted based on a pressure differential between the intake manifold and an ambient atmosphere without the use of electrical components and/or motors. However, the venturi device may also be actuated by a motor, as described above. In one example, the venturi device may be adjusted toward the annular fixture for a decreasing engine load. In this way, the cross-sectional flow through area of the intake passage for ambient air to flow to the engine is decreased. As such, less ambient air may flow to the engine while a venturi effect generated in the intake passage may increase, resulting in increased vacuum production. Conversely, the venturi device may be adjusted away from the annular fixture for an increasing engine load. In this way, the cross-sectional flow through area of the intake passage is increased, thereby allowing more ambient air to flow to the engine. This may result in a decreased venturi effect and less vacuum production. In one example, the venturi device may move to a fully closed position, where the venturi device is pressed against the annular fixture, when the engine is in a low-load or at idle. Alternatively, the venturi device may move to a fully open position, where the venturi device is farthest away from the annular fixture, when the engine is in a high-load, for example.

At 506, the method 500 may determine if a vacuum in the intake passage is greater than a threshold vacuum. As described above, the threshold vacuum may be based on a vacuum stored in the vacuum consumption device. As a result, the threshold vacuum may be a dynamic threshold that changes proportionally to vacuum stored in the vacuum consumption device. Vacuum in the intake passage may be dependent on one or more of the venturi device position, ambient air flow, and intake manifold pressure. Intake passage vacuum may increase in response to one or more of the position of the venturi device being closer to the annular fixture, less ambient air flowing through the intake passage, and intake manifold pressure being low. If the vacuum in the intake passage is not greater than the threshold vacuum, then the method 500 proceeds 508 where the check valve is closed and vacuum is not provided to the vacuum consumption device. Thus, air does not flow from the vacuum consumption device to the intake passage when the check valve is in a closed position and vacuum in the vacuum consumption device does not increase.

Vacuum in the intake passage may be less than the threshold vacuum if vacuum in the vacuum consumption device was recently replenished or if the venturi device is in a more open position (fully open position, for example). If the vacuum consumption device was recently replenished, then the vacuum in the vacuum consumption device may be relatively high. As such the threshold vacuum may be relatively high, resulting in a lower likelihood of the intake passage vacuum forcing the check valve open. As described above, the venturi device in a more open position may generate less vacuum due to an increased space between the venturi device and the annular fixture. In some examples, additionally or alternatively, vacuum generated in the intake passage following replenishing the vacuum of the vacuum consumption device or actuating the venturi device to a more open position may be greater than the threshold vacuum such that vacuum is provided to the vacuum consumption device.

At 510, the method 500 determines if the engine load is greater than a threshold load, where the threshold load is based on lower engine loads. In one example, lower engine loads include low-load and idle. In another example, the threshold load is only based on an engine load at idle. If the engine load is not greater than the threshold load (mid-load or high-load, for example), then the venturi device may be in a more closed position (a fully closed position, for example) and the method 500 proceeds to 512. In the fully closed position, the manifold pressure is much less than an ambient atmosphere pressure. Thus, the venturi device is pressed against the annular fixture such that the two are in sealed contact and ambient air may not flow through the intake passage to the engine.

At 514, the method 500 includes adjusting engine fueling based on no air flowing to the engine. In one example, the method may decrease fueling to substantially zero since combustion is not taking place in the absence of oxygen. In other examples, fueling may be reduced to an amount greater than zero thereby allowing fuel to already be present within an engine cylinder for a subsequent combustion. During the subsequent combustion, fueling may return to stoichiometric, however, exhaust gas expelled from the cylinder is rich due to the previous fuel injection(s) during no air flow.

Returning to 510, if the method 500 determines that the engine load is greater than the threshold load, then the method 500 may proceed to 516 to flow ambient air to the engine. As such, the venturi device is in a more open position (in an intermediate position or fully open position, for example) allowing ambient air to flow through a space (venturi passage 402 in the embodiments of FIGS. 4A-4C, for example) between the venturi device and the annular fixture to the engine. At 518, the method 500 includes adjusting engine fueling to meet a desired air/fuel ratio based on the engine load at 516. For example, if the desired air/fuel ratio is stoichiometric, then fueling may increase as the venturi device moves to an increasingly open position due to more ambient air flowing to the engine.

Returning to 506, if the method 500 determines that the vacuum in the intake passage is greater than the threshold vacuum, then the method 500 proceeds to 520 to open the check valve and provide vacuum to the vacuum consumption device. When the check valve is open, air flows out of the vacuum consumption device to the intake passage via one or more of the venturi device and the annular fixture before flowing to the engine.

At 522, the method 500 determines if the engine load is greater than the threshold load, as described above at 510 of the method 500. If the engine load is not greater than the threshold load, then the method 500 proceeds to 524 to flow suck flow to the engine without flowing ambient air. The ambient atmosphere pressure is much greater than the intake manifold pressure. Thus, the venturi device is pressed against the annular fixture, with apertures of the annular fixture and perforations of the venturi device being exposed to the portion of the intake passage fluidly coupled to the intake manifold. The low pressure of the intake manifold (strong vacuum of the intake manifold, for example) may draw air from the vacuum consumption device, through the apertures and perforations, and into the intake passage. Thus, when the check valve is open and the engine load is not greater than the threshold load (engine idle, for example), then the engine may only receive suck flow and does not receive ambient air.

At 524, the method 500 includes adjusting engine fueling based on the suck flow. In one example, engine fueling may be adjusted provide a desired air/fuel ratio (stoichiometric, for example). This allows the engine to efficiently maintain an idle operation. In some examples, additionally or alternatively, fueling may be adjusted to other values outside of stoichiometric (rich or lean, for example). As such, the fueling may be substantially zero in one example, thereby allowing only air to flow to an exhaust passage. In other examples, the fueling may be rich to allow an excess of fuel to flow to aftertreatment device or other components located along the exhaust passage.

Returning to 522, if the method 500 determines that the engine load is greater than the threshold load, then the method 500 proceeds to 528 to flow both ambient air and suck flow to the engine. When the engine load is greater than the threshold load, a pressure of the intake manifold is closer to the ambient pressure than when the engine load is less than the threshold load. As a result, the increased intake manifold pressure in combination with a force from a spring (spring 384 in the embodiment of FIG. 3, for example) push the venturi device away from the annular fixture to a more open position (intermediate position or fully open position, for example). As such, an amount of ambient air flowing through the intake passage to the engine may be based on vehicle speed, venturi device position, and other conditions. Faster vehicle speeds may provide more ambient air flow than slower vehicle speeds. A more open position of the venturi device may provide more ambient air flow than a less open position of the venturi device. Thus, the fully open position may provide the most ambient air, in one example. Likewise, an amount of suck flow flowing through the intake passage to the engine may also be based on vehicle speed and venturi device position. Faster vehicle speeds may provide increased vacuum, thereby providing more suck flow than lower vehicle speeds. Conversely, more open positions of the venturi device may generate less vacuum than less open positions, thereby flowing less air from the vacuum consumption device to the intake passage.

At 530, the method 500 includes adjusting a fuel injection based on an amount of ambient air and suck flow flowing to the engine. As an example, if the engine load is high and the venturi device is in a fully open position, then the fuel injection may be adjusted to inject a maximum amount of fuel.

In this way, a position of the venturi device may be adjusted based on pressure changes in the intake manifold. The venturi device is adjusted without electrical components and/or hardware. The controller may adjust a fuel injection based on displacement of the venturi device along the intake passage. In one example, the fuel injection may increase as the venturi device moves to a more open position and the fuel injection may decrease as the venturi device moves to a more closed position.

FIG. 6 shows a map 600 depicting an example fuel injection adjustment based on a venturi device position and modifications in engine operating parameters in response to the venturi device adjustment. Map 600 shows intake manifold vacuum at plot 602, engine load at plot 604 and threshold load at plot 606, venturi device position at plot 608, intake passage vacuum at plot 610 and threshold vacuum at plot 612, vacuum consumption device (VCD) vacuum at plot 614, check valve position at plot 616, ambient air flow at plot 618, suck flow (air flow from the VCD to the intake passage, for example) at plot 620, and fuel injection volume at plot 622. All the above are plotted against time on the horizontal axis. The threshold load is based on a lower engine load and/or idle, as described above. In the embodiment of FIG. 6, the VCD is a brake booster. However, as described above, the VCD may be other suitable vacuum consuming devices.

Prior to $t_1$, a vehicle may be moving in a steady state condition with high speed. The engine load is high and the venturi device is in a more open position. In one example, the venturi device is in a fully open position prior to t1. Due to the venturi device being in the fully open position and the engine load being a high load, ambient air flow may be relatively high which in turn fills a vacuum of the intake manifold, resulting in a low intake manifold vacuum. As described above, when the venturi device is in the fully open position, a vacuum generated at the venturi device and annular fixture may be decreased. As such, the intake passage vacuum is not greater than the threshold vacuum. In the example of FIG. 6, the threshold vacuum may follow the plot of the VCD vacuum, where the threshold vacuum is superimposed onto the plot of the intake passage vacuum for reasons of simplicity. In this way, plot 600 may more easily reveal when the intake passage vacuum exceeds the threshold vacuum (VCD vacuum). The VCD vacuum is high, which may be due to one or more of the VCD recently being replenished and a lack of vacuum storage consumption (braking has not taken place for a long time, for example). Since the check valve is in the closed position, suck flow is substantially zero. Thus, the fuel injection may be adjusted to compensate for only the ambient air flow. The fuel injection volume is high in response to the high ambient air flow to meet a desired air/fuel ratio.

In some examples, a change in the amount of ambient air flow may more greatly impact a fuel injection volume adjustment than a change in the amount of suck flow. For example, if ambient air flow increases and suck flow decreases, the fuel injection volume may slightly increase. This may be due to the limited nature of the suck flow (air available from the vacuum consumption device is more limited than air from the ambient atmosphere, for example). Alternatively, in some examples, a change in the amount of ambient air flow may equally impact or have less of an impact on fuel injection volume adjustments compared to a change in the amount of suck flow.

At $t_1$, the engine load begins to decrease as a driver actuates a brake pedal. As a result, the venturi device move toward a more closed position thereby reducing ambient air flow. This increases the intake manifold vacuum due to less air filling the vacuum of the manifold. Thus, the intake manifold vacuum is inversely proportional to ambient air flow. Furthermore, vacuum in the intake passage increases as the venturi device moves to the more closed position due to the increased constriction of the venturi passage located between the venturi device and the annular fixture. The VCD vacuum begins to decrease as the brake pedal is depressed. In this way, vacuum is consumed to amplify a braking efficiency. However, the intake passage vacuum does not increase to a vacuum level greater than the threshold vacuum and the check valve remains closed. Thus, a vacuum of the VCD is still greater than the intake passage vacuum.

As such, suck flow remains substantially zero. Thus, the fuel injection volume is reduced corresponding to a reduction of only the ambient air flow to maintain a desired air/fuel ratio. Between $t_1$ and $t_2$, the engine load continues to decrease and the brake pedal is still depressed, resulting in the VCD vacuum to continue to decrease. The venturi device continues to move to a more closed position, thereby reducing ambient air flow and increasing intake passage vacuum. The intake passage vacuum is still less than the threshold vacuum. As such, the check valve remains closed and the suck flow remains substantially zero. The intake manifold vacuum continues to increase as less air flows to the engine. The fuel injection volume continues to decrease based on the reduced ambient air flow.

At $t_2$, the engine load begins to even out as the brake pedal is released and remains above the threshold load. In one example, the engine load is a mid-load. As a result, the venturi device is at an intermediate position between the more open and more closed positions. The intake manifold vacuum evens out as the ambient air flow remains substantially constant between high and low flows. The intake passage vacuum continues to slightly increase due to one or more of the position of the venturi device, ambient air flow, and the intake manifold vacuum. The VCD vacuum decreases such that the threshold vacuum is less than the intake passage vacuum. As a result, the check valve moves to an open position and suck flow increases (air begins to flow from the VCD to the intake passage. As a result, the fuel injection volume begins to increase to compensate for the suck flow flowing to the engine. Between $t_2$ and $t_3$, the engine load continues to remain relatively constant. As a result, the intake manifold vacuum, the venturi device position, intake passage vacuum, and the ambient air flow also remain relatively constant. The VCD vacuum increases as air from the VCD flows to the intake passage. As such, the threshold vacuum moves closer to the intake passage vacuum. The amount of suck flow may correspond to a difference between the intake passage vacuum and the threshold vacuum, wherein the suck flow increases as the difference increases. Thus, the suck flow increases closer to $t_2$ and decreases closer to $t_3$ as the threshold vacuum approaches the intake passage vacuum. The check valve remains open so long as the intake passage vacuum is greater than the threshold vacuum. In one example, the check valve is a bi-positional valve, where the valve is either fully open or fully closed. In other examples, the check valve may move through a range of position between fully open and fully closed. The fuel injection volume may increase and decrease similar to the suck flow to provide the engine with a desired air/fuel ratio.

At $t_3$, the intake manifold vacuum is relatively constant between high and low, the engine load is relatively constant and above the threshold load, the venturi device position is relatively constant in an intermediate position, and the ambient air flow is relative constant near a low mass air flow. The VCD vacuum continues to slightly increase such that the threshold vacuum surpasses the intake passage vacuum, which closes the check valve and prohibits air from flowing from the VCD to the intake passage. Thus, the suck flow is substantially zero and the fuel injection is decreased to account for only the ambient air flow. Between $t_3$ and $t_4$, the engine load, the intake manifold vacuum, the venturi device position, the intake passage vacuum, the VCD vacuum, the ambient air flow, the suck flow, and the fuel injection volume remain substantially constant. Thus, the check valve is still in a closed position and the intake passage vacuum is less than the threshold vacuum.

At $t_4$, the engine load begins to decrease due to the brake pedal being depressed, which decreases the VCD vacuum. The venturi device moves toward the more closed position, which allows less ambient air flow while allowing the intake passage vacuum to increase due to the increased restriction of the intake passage. As such, the intake passage vacuum surpasses the threshold vacuum due to one or more of the VCD vacuum decreasing and the intake passage vacuum increasing. Thus, air flows from the VCD to the intake passage (suck flow increases) due to the check valve opening. Also, the intake manifold vacuum increases as less ambient air flow to the engine which may increase vacuum in the intake passage. By doing this, the fuel injection volume is adjusted (decreased, for example) to compensate for the decreased ambient air flow and increased suck flow. In this way, the ambient air flow may decrease more rapidly than a rate of suck flow increase. Between $t_4$ and $t_5$, the engine load continues to decrease toward the threshold load. The venturi device moves toward the more closed position, which results in less ambient air flow. This creates more intake manifold vacuum and more intake passage vacuum. The VCD vacuum slightly decreases due to the brake pedal being depressed simultaneously to vacuum from the intake passage being provided to the VCD. Thus, vacuum of the VCD may be consumed and replenished simultaneously, in one example. Due to an increased difference between the intake passage vacuum and the threshold vacuum, suck flow output through the open check valve to the intake passage increases. In one example, the rate of the suck flow increase may be substantially equal to the rate of ambient air flow decrease. As a result, the fuel injection volume may remain substantially constant. As described above, the ambient air flow may have a greater effect on the fuel injection volume such that the fuel injection volume decreases between $t_4$ and $t_5$, in one example.

At $t_5$, the engine load falls below the threshold engine load. Thus, the engine load may be a low-load in one example. In another example, additionally or alternatively, the engine load may be an idle load. The intake manifold vacuum continues to decrease as the venturi device is moved toward the more closed position and as a result, a decreasing amount of ambient air is delivered to the engine. The VCD vacuum begins to increase such that the threshold vacuum approaches the intake passage vacuum. As a result, the amount of suck flow entering the intake passage begins to decrease. As a result, the fuel injection volume begins to decrease in correspondence with a reduction of both the ambient air flow and the suck flow. Between $t_5$ and $t_6$, the engine load continues to decrease below the threshold load and as a result, the venturi device continues to move to the more closed position until it reaches a fully closed position. While in the fully closed position, ambient air flow may reach a lowest mass flow such that substantially zero ambient air flows to the engine. Thus, the intake manifold vacuum reaches a highest vacuum amount. The intake passage vacuum is substantially equal to the intake manifold vacuum when the venturi device is in the fully closed position. In this way, vacuum in the intake passage is not generated by flowing air through the venturi passage located between the venturi device and the annular fixture, but by preventing ambient air from filling the vacuum of the intake manifold. Thus, the vacuum in the intake passage remains relatively high and remains greater than the threshold vacuum. The VCD vacuum increases as vacuum from the intake manifold is provided to replenish the VCD vacuum through the open check valve. Suck flow decreases as the VCD vacuum is replenished due to less air from the VCD being available to be drawn into the intake passage. The fuel injection volume is adjusted based on the amount of suck flow flowing to the engine.

At $t_6$, the engine load begins to increase as a brake pedal is released, but the engine load remains below the threshold load. As a result, the venturi device remains in the fully closed position. This may correspond to an idle operation of the engine. As such, the ambient air flow remains at substantially zero, the intake manifold vacuum remains relatively high, and the intake passage vacuum remains relatively high. The check valve is still open due to the VCD vacuum (and therefore the threshold vacuum) not being greater than the intake passage vacuum. However, the VCD vacuum increases as air flows out of the VCD and into the intake passage via the vacuum supplied to the venturi device and annular fixture. Due to the threshold vacuum approaching the intake passage vacuum, the amount of suck flow decreases and as such, the fuel injection volume correspondingly decreases. Between $t_6$ and $t_7$, the engine load continues to increase toward the threshold load, but still does not exceed the threshold load. The venturi device remains in the fully closed position. Thus, the intake manifold, the ambient air flow, and the intake passage vacuum remain substantially constant. The VCD vacuum increases due to the brake pedal vacuum from the intake manifold being supplied to the VCD through the open check valve. Furthermore, the VCD vacuum may increase more rapidly due to its vacuum no longer being consumed (brake pedal is released, for example). Thus, the threshold vacuum approaches the intake vacuum and less suck flow is drawn into the intake passage. This results in the fuel injection volume decreasing.

At $t_7$, the engine load is equal to the threshold load. As a result, the venturi device begins to move to the more open position. This may include flowing a relatively small amount of ambient air into the intake passage thereby decreasing the intake manifold vacuum. Furthermore, intake manifold vacuum and intake passage vacuum begin to slightly decrease. The intake passage vacuum may be substantially equal to the threshold vacuum such that the check valve moves to a closed position and allows substantially zero suck flow to flow to the intake passage. Thus, the VCD vacuum is no longer replenished and remains substantially high due to the vacuum in the VCD not being consumed. The fuel injection volume may remain substantially constant due to the introduction of ambient air and termination of suck flow. In other examples, the fuel injection may decrease or increase. Between $t_7$ and $t_8$, the engine load increases toward a high-load and is greater than the threshold load. The venturi device moves to a more open position which decreases the intake passage vacuum. The intake passage vacuum remains below the threshold vacuum and the VCD vacuum remains substantially constant since the check valve is still closed and the brake pedal is not being depressed. Suck flow remains at substantially zero. Furthermore, the ambient air flow increases and as a result, the intake manifold vacuum correspondingly decreases. The fuel injection volume increases in conjunction with the increase in ambient air flow to meet a desired air/fuel ratio.

At $t_8$, the engine load reaches a load between a mid-load and a high-load. The venturi device moves to an intermediate position located between a fully open position and the fully closed position. In one example, the venturi device is in an intermediate position closed to the fully open position than the fully closed position. Thus, the ambient air flow is equal to an air flow closer to a high airflow than a low air flow. The intake manifold vacuum decreases due to the increased air flow. The intake passage vacuum decreases due to the more open position of the venturi device. The VCD vacuum remains relatively high due to the brake pedal not being depressed and the check valve remaining closed. Since the check valve is closed, suck flow is substantially zero. The fuel injection volume is adjusted to correspond with the increase in ambient air flow. After $t_8$, the engine load remains substantially constant between the mid- and high-loads. Thus, the venturi device position, intake manifold vacuum, intake passage vacuum, VCD vacuum, ambient air flow, suck flow, check valve position, and fuel injection volume are substantially constant.

In this way, a vacuum consumption device may be receive vacuum from two separate components located along an intake passage. An amount of vacuum replenished to the vacuum consumption device may be adjusted by displacing a venturi device to and away from an annular fixture, where the amount increases as the venturi device moves closer to the annular fixture. In one example, the vacuum is generated in venturi passages of the venturi device and the annular fixture as ambient air flows through the intake passage to an intake manifold. Conversely, the venturi device may be pressed against (in face-sharing contact, for example) with the annular fixture to substantially prevent ambient air flow to the intake manifold while providing an increased amount of vacuum to the vacuum consumption device. The technical effect of having the venturi device displaceable to and away from the annular fixture is to adjust an amount of vacuum provided to the vacuum consumption device while also meeting an air/fuel ratio demand based on an engine load. The venturi device and annular fixture are relatively compact and easy to manufacture, which may reduce an engine size and/or manufacturing cost.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system comprising:

a venturi device displaceable along an axis of an intake passage;

an inwardly projecting fixture radially spaced away from the axis and in sealing contact with an intake pipe of the intake passage; and a first venturi passage located between the venturi device and the intake pipe and a second venturi passage located between the axis and the fixture, wherein the venturi device is annular and radially spaced away from the intake pipe, and where the fixture is radially spaced away from the axis, and where a smallest radial distance between the intake pipe and the venturi device is smaller than a smallest radial distance between the axis and the fixture, wherein the smallest radial distance between the axis and the fixture corresponds to an apex of the fixture, and where the apex of the fixture comprises a plurality of apertures located on the fixture.

2. The system of claim 1, wherein the fixture comprises a first surface upstream of a second surface relative to a direction of intake air flow, and where the first and second surfaces are angled relative to the direction of intake air flow.

3. The system of claim 1, wherein the venturi device comprises an upstream first surface and a downstream second surface, and where the upstream first surface and downstream second surface are angled relative to a direction of intake air flow.

4. The system of claim 1, wherein the venturi device and the fixture are both fluidly coupled to a vacuum consumption device.

5. The system of claim 1, wherein the fixture is annular and further comprises a sealing surface in sealing contact with an interior surface of the intake pipe.

6. The system of claim 1, wherein the smallest radial distance between the intake pipe and the venturi device corresponds to an apex of the venturi device, and where the apex of the venturi is upstream of a plurality of perforations located on the venturi device.

7. The system of claim 6, wherein the first venturi passage is fluidly coupled to an interior chamber of the venturi device via the plurality of perforations.

8. The system of claim 1, wherein the second venturi passage is fluidly coupled to an annular chamber of the fixture via the plurality of apertures.

9. A system comprising:

an intake passage of an intake pipe;

a tear-drop shaped hollow and sliding object radially spaced away from the intake pipe;

an inwardly protruding projection from the intake pipe surrounding the object;

a passage through the projection forming a first venturi passage; and one or more openings in the object exposing an interior of the object to the intake pipe, the openings downstream of an apex of an outer surface curvature of the object, wherein the apex of the outer surface of the object touches a surface of the projection in a fully closed position, and where the one or more openings in the object are fluidly coupled to the first venturi passage in the fully closed position, wherein the object and projection are fluidly coupled to a vacuum consumption device, and where the fully closed position provides more vacuum to the vacuum consumption device than other positions of the object, and where ambient air does not flow to an intake manifold when the object is in the fully closed position.

10. The system of claim 9, wherein the projection and the object are mechanically actuated.

11. The system of claim 9, wherein the object comprises a second venturi passage located between it and the intake pipe, and where the second venturi passage merges with the first venturi passage as the object moves closer to the projection.

12. The system of claim 9, where the object slides along the intake passage based on a pressure of the intake manifold.

13. A system comprising:

an engine intake passage;

a tear-drop shaped hollow and sliding object radially spaced away from the intake pipe;

an annular fixture having a passage therethrough fluidically coupled with apertures at a narrowed apex of the fixture; and openings in the object exposing an interior of the object to the intake pipe, downstream of the apex, fluidically coupled with the passage exterior to the intake passage, and combining vacuum generation.

14. The system of claim 13, wherein the object is mechanically actuated.

15. The system of claim 13, where the object slides along the intake passage based on a pressure of an intake manifold, and each of the passages through the annular fixture and the object are fluidically coupled to a vacuum consumption device.

* * * * *